US012318009B2

(12) United States Patent
Rawls-Meehan et al.

(10) Patent No.: US 12,318,009 B2
(45) Date of Patent: Jun. 3, 2025

(54) FOLDABLE MATTRESS FOUNDATION

(71) Applicant: Ascion, LLC, Bloomfield Hills, MI (US)

(72) Inventors: Martin Bordley Bepko Rawls-Meehan, Birmingham, MI (US); Kushan Nileshbhai Gajjar, West Bloomfield, MI (US); Qianyu Liang, Rochester Hills, MI (US)

(73) Assignee: Ascion, LLC, Bloomfield Hills, MI (US)

( * ) Notice: Subject to any disclaimer, the term of this patent is extended or adjusted under 35 U.S.C. 154(b) by 0 days.

(21) Appl. No.: 18/664,403

(22) Filed: May 15, 2024

(65) Prior Publication Data

US 2024/0298808 A1 Sep. 12, 2024

Related U.S. Application Data

(63) Continuation of application No. 18/467,972, filed on Sep. 15, 2023, now Pat. No. 12,011,092.

(Continued)

(51) Int. Cl.
*A47C 19/02* (2006.01)
*A47C 19/12* (2006.01)

(52) U.S. Cl.
CPC ..... *A47C 19/025* (2013.01); *A47C 19/122* (2013.01)

(58) Field of Classification Search
CPC ..... A47C 19/025; A47C 19/122; A47C 19/12; A47C 19/021; A47C 19/045; A47C 19/04;

(Continued)

(56) References Cited

U.S. PATENT DOCUMENTS 253,463 A * 2/1882 Woods ..... A47C 23/005 5/250
1,360,983 A * 11/1920 Burton ..... A47C 19/122 5/154

(Continued)

FOREIGN PATENT DOCUMENTS

CN 201668162 U 12/2010
CN 202760721 U 3/2013

(Continued)

OTHER PUBLICATIONS https://classicbrands.com/instant-folding-7-5-inch-regular-profile-foundation/; High Profile 7.5-Inch Instant Folding Mattress Foundation | Box Spring Replacement, accessed: Nov. 14, 2022 (3 pages).

(Continued)

*Primary Examiner* — Justin C Mikowski
*Assistant Examiner* — Alison N Labarge
(74) *Attorney, Agent, or Firm* — Carlson, Gaskey & Olds, P.C.

(57) ABSTRACT

A mattress foundation includes a top frame and a bottom frame. Bracket assemblies are between the top frame and the bottom frame. The bottom frame has a first bottom segment and a second bottom segment each rotatably connected to bracket assemblies. The top frame has a first top segment and the second top segment each rotatably connected to bracket assemblies. The first bottom segment, the second bottom segment, the first top segment, and the second top segment are rotatable relative to each other and the bracket assemblies between a folded position and an unfolded position.

20 Claims, 29 Drawing Sheets

Related U.S. Application Data

(60) Provisional application No. 63/498,345, filed on Apr. 26, 2023, provisional application No. 63/480,305, filed on Jan. 18, 2023, provisional application No. 63/407,389, filed on Sep. 16, 2022.

(58) Field of Classification Search
CPC ..... A47C 23/0005; A47C 17/70; F16B 12/56; F16B 12/54; A61G 7/0012; A47B 9/14
See application file for complete search history.

(56) References Cited

U.S. PATENT DOCUMENTS

| | | | | |
|---|---|---|---|---|
| 2,651,787 | A | 9/1953 | Piliero | |
| 3,121,237 | A | 2/1964 | Brindisi | |
| 3,683,429 | A * | 8/1972 | Mis | A47C 19/024 5/300 |
| 4,048,683 | A | 9/1977 | Chen | |
| 5,996,145 | A * | 12/1999 | Taylor | A47C 19/045 5/310 |
| 7,231,676 | B2 | 6/2007 | Cloer | |
| 7,503,086 | B2 | 3/2009 | Wickstrom et al. | |
| 7,937,788 | B2 | 5/2011 | Felix | |
| 8,006,329 | B2 | 8/2011 | Oh | |
| 8,312,576 | B1 | 11/2012 | Oh | |
| 8,370,973 | B1 | 2/2013 | Oh | |
| 8,407,834 | B1 | 4/2013 | Oh | |
| 8,621,685 | B2 | 1/2014 | Jin | |
| 8,769,740 | B2 * | 7/2014 | Oh | A47C 19/12 5/177 |
| 8,832,876 | B1 | 9/2014 | Oh | |
| 8,898,832 | B2 | 12/2014 | Oh | |
| 8,978,176 | B1 | 3/2015 | Oh | |
| 9,027,181 | B1 | 5/2015 | Yu | |
| 9,226,590 | B1 | 1/2016 | Hull et al. | |
| 9,456,698 | B2 | 10/2016 | Oh | |
| 9,456,699 | B1 | 10/2016 | Oh | |
| 9,474,385 | B2 | 10/2016 | Oh | |
| 9,492,017 | B2 | 11/2016 | Oh | |
| 9,526,347 | B2 | 12/2016 | Boyd | |
| 9,538,850 | B2 | 1/2017 | Oh | |
| 9,782,014 | B2 | 10/2017 | Lee et al. | |
| 9,814,322 | B2 | 11/2017 | Hull et al. | |
| 10,034,551 | B2 | 7/2018 | Hull | |
| 10,123,629 | B2 | 11/2018 | Choi | |
| 10,285,506 | B2 | 5/2019 | Choi | |
| 10,321,767 | B2 | 6/2019 | Jin | |
| 10,561,251 | B2 | 2/2020 | Choi | |
| 10,561,252 | B2 | 2/2020 | Choi | |
| 10,638,850 | B2 | 5/2020 | Skaggs | |
| 10,646,047 | B2 | 5/2020 | Oh | |
| 10,694,860 | B2 | 6/2020 | Jin | |
| 10,702,070 | B2 | 7/2020 | Oh | |
| 10,952,538 | B2 | 3/2021 | Choi | |
| 11,006,763 | B1 | 5/2021 | Oh | |
| 11,185,168 | B2 | 11/2021 | Choi | |
| 11,278,123 | B2 | 3/2022 | Choi | |
| 11,344,131 | B2 | 5/2022 | Choi | |
| 11,369,206 | B2 | 6/2022 | Choi | |
| 11,382,434 | B2 | 7/2022 | Choi | |
| 2006/0021136 | A1 | 2/2006 | Cheng | |
| 2007/0039099 | A1 * | 2/2007 | Kozlowski | A47C 19/045 5/236.1 |
| 2009/0183311 | A1 | 7/2009 | Nguyen et al. | |
| 2009/0293193 | A1 | 12/2009 | Neatherry et al. | |
| 2012/0042449 | A1 | 2/2012 | Hull et al. | |
| 2013/0276228 | A1 | 10/2013 | Hsieh | |
| 2013/0276229 | A1 | 10/2013 | Hsieh | |
| 2014/0283299 | A1 | 9/2014 | Oh | |
| 2016/0081484 | A1 | 3/2016 | Hull et al. | |
| 2016/0143447 | A1 * | 5/2016 | Hull | A47C 23/005 5/202 |
| 2016/0157621 | A1 | 6/2016 | Oh | |
| 2016/0157622 | A1 | 6/2016 | Oh | |
| 2016/0206110 | A1 | 7/2016 | Oh | |
| 2016/0262547 | A1 * | 9/2016 | Jin | A47C 19/021 |
| 2016/0302583 | A1 | 10/2016 | Oh | |
| 2016/0316292 | A1 | 11/2016 | Choi | |
| 2018/0249820 | A1 | 9/2018 | Boyer | |

FOREIGN PATENT DOCUMENTS

| | | | | |
|---|---|---|---|---|
| CN | 202790059 | U | 3/2013 | |
| CN | 205379091 | U | 7/2016 | |
| CN | 208610307 | U | 3/2019 | |
| CN | 209733190 | U | 12/2019 | |
| CN | 210383351 | U | 4/2020 | |
| CN | 213640288 | U | 7/2021 | |
| CN | 113892780 | A | 1/2022 | |
| CN | 217065832 | U | 7/2022 | |
| CN | 217524418 | U | 10/2022 | |
| DE | 20018672 | U1 | 2/2001 | |
| DE | 10340342 | A1 * | 3/2005 | A47B 9/14 |
| DE | 202021102933 | U1 * | 7/2021 | |
| JP | 2001017272 | A | 1/2001 | |
| JP | 2009160200 | A | 7/2009 | |
| WO | 2018040718 | A1 | 3/2018 | |

OTHER PUBLICATIONS https://www.homedepot.com/p/Hercules-Instant-Folding-Full-Low-Profile-4-Inch-Mattress-Foudnation-Box-Spring-Replacement-125024-5230/305502189; Hercules Instant Folding Full Low Profile 4-Inch Mattress Foundation Box Spring Replacement, accessed: Nov. 14, 2022 (5 pages).

https://www.ebay.com/itm/115306267357; 14" Full Size Metal Platform Bed Foldable Mattress Foundation Tool-Free Assembly, accessed: Nov. 14, 2022 (4 pages).

International Search Report and Written Opinion for PCT/US23/74313 mailed Jan. 12, 2024 (11 pages).

* cited by examiner

FOLDABLE MATTRESS FOUNDATION

CROSS-REFERENCE TO RELATED APPLICATIONS

The subject patent application is a continuation of U.S. patent application Ser. No. 18/467,972 filed on Sep. 15, 2023, which claims priority to and all the benefits of U.S. provisional patent application No. 63/407,389 filed on Sep. 16, 2022, U.S. provisional patent application No. 63/480,305 filed on Jan. 18, 2023, and U.S. provisional patent application No. 63/498,345 filed on Apr. 26, 2023, all of which are herein incorporated by reference in their entirety.

BACKGROUND

A mattress foundation is designed to support a mattress. In some examples, the mattress foundation has a top frame and a bottom frame that are both foldable for ease of transportation and/or storage. In other words, the mattress foundation in a folded position consumes less space for shipping, moving, storage, etc. In such examples, the top frame and the bottom frame are un-foldable for use, e.g., after delivery to a user, after storage by user, etc. In an unfolded position, the mattress support is configured to support a mattress and users of the mattress.

DETAILED DESCRIPTION

Figure 1:
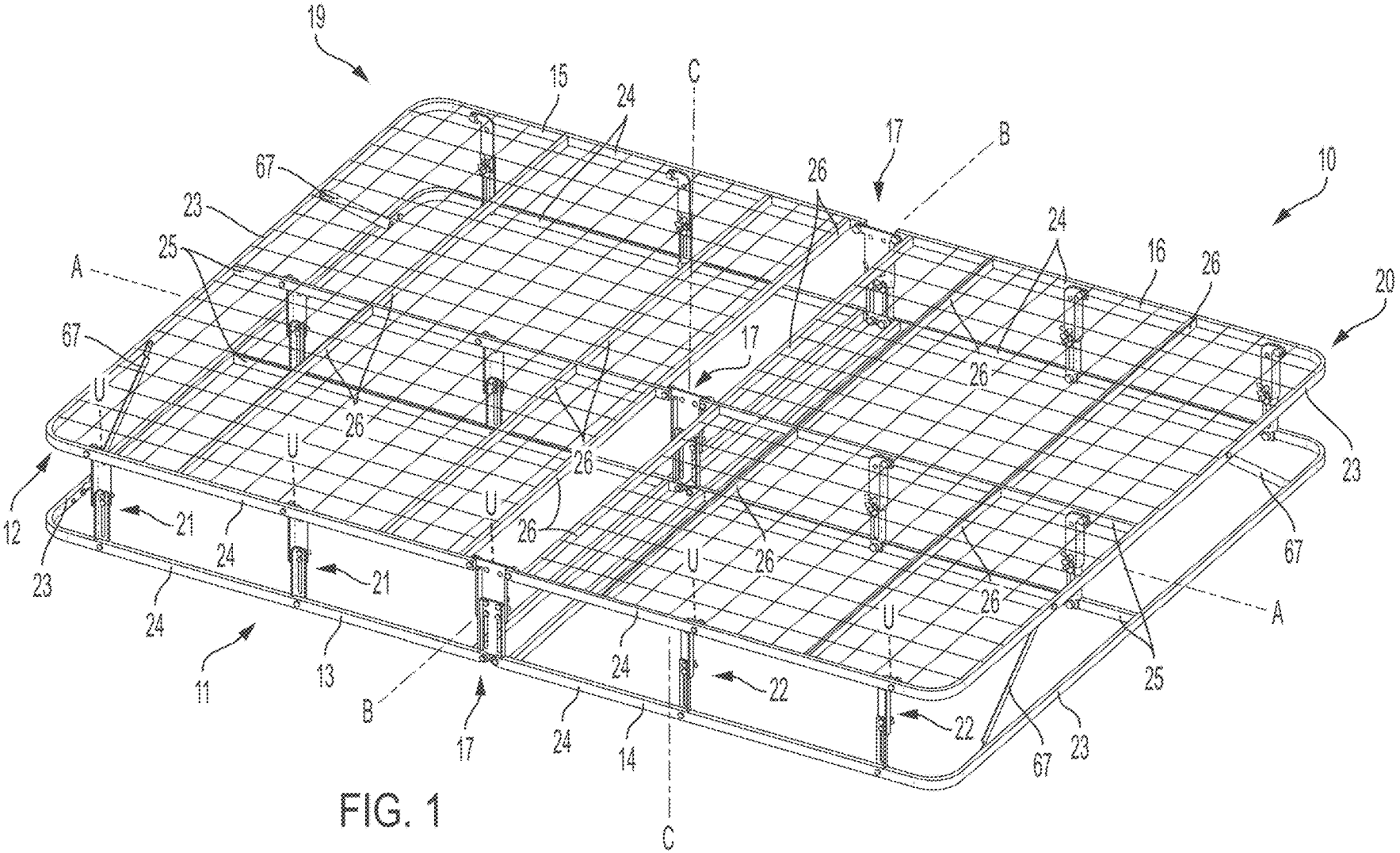
FIG. 1 is a perspective view of a mattress foundation in an unfolded position and a raised position.

With reference to the Figures, wherein like numerals indicate like parts throughout the several views, a mattress foundation 10 includes a first frame and a second frame. The first frame has a first segment and a second segment and the second frame has a first segment and a second segment. The mattress foundation 10 includes bracket assemblies between the first frame and the second frame. The mattress foundation 10 is foldable. Specifically, the first frame and the second frame fold relative to the bracket assemblies between a folded position (FIG. 5) and an unfolded position (e.g., FIGS. 1-4). Specifically, the first segment and the second segment of the first frame rotate relative to each other and the bracket assemblies between the folded position and the unfolded position and the first segment and the second segment of the second frame rotate relative to each other and the bracket assemblies between the folded position and the unfolded position. Different examples of the mattress assembly are shown in the figures and common numerals are used to identify common features.

The mattress foundation 10 is foldable for case of transportation and/or storage and is unfoldable for use, e.g., after delivery to a user, after storage by user, etc. The mattress foundation 10 may be repeatedly unfolded from the folded position to the unfolded position and folded from the unfolded position to the folded position as selected by a user, as described further below, for use, storage, transport, etc.

The mattress foundation 10 is designed to support a mattress (not shown). The mattress foundation 10 may be sized to support any suitable size mattress, e.g., single, twin, full, queen, king, California king, etc. In some examples, the mattress may be of the type currently known in the art.

The numerical adjectives, such as "first," "second," "third," "fourth," etc., are used herein as identifiers and do not indicate order or importance. As an example, the first frame may be a bottom frame 11 and the second frame may be a top frame 12, i.e., the first frame is below the second frame in the unfolded position, as shown in the examples in the figures. In other examples, the first frame may be above the second frame in the unfolded position. As set forth above, the top frame 12 includes the first segment and the second segment of the top frame 12 and the bottom frame 11 includes the first segment and the second segment of the bottom frame 11. For example, in the example shown in the figures, the bottom frame 11 includes a first bottom segment 13 and a second bottom segment 14 and the top frame 12 includes the first top segment 15 and the second top segment 16.

As set forth above, bracket assemblies are between the first frame and the second frame, e.g., between the bottom frame 11 and the top frame 12. Specifically, the bracket assemblies include middle bracket assemblies 17 and side bracket assemblies 21, 22, specifically first side bracket assemblies 21 and second side bracket assemblies 22. The mattress foundation 10 includes a first side 19 and a second side 20. The first side 19 includes the first bottom segment 13, the first top segment 15, and the first side bracket assemblies 21. The second side 20 includes the second bottom segment 14, the second top segment 16, and second side bracket assemblies 22.

The middle bracket assemblies 17 each rotatably connect the first side 19 to the second side 20. Specifically, each middle bracket assembly 17 rotatably connects the first bottom segment 13, the second bottom segment 14, the first top segment 15, and the second top segment 16. Some of the side bracket assemblies 21, 22, e.g., the first side bracket assemblies 21, rotatably connect the first bottom segment 13 with the first top segment 15 and others of the side bracket assemblies 21, 22, e.g., the second side bracket assemblies 22, rotatably connect the second bottom segment 14 with the second top segment 16. The first bottom segment 13, the second bottom segment 14, the first top segment 15, and the second top segment 16 each rotate about each of the middle bracket assemblies 17 between the folded position and the unfolded position. The first bottom segment 13 and the first top segment 15 rotate relative to the respective side bracket assemblies 21, 22 as the bottom frame 11 and the top frame 12 rotate between the folded position and the unfolded position. The second bottom segment 14 and the second top segment 16 rotate relative to the respective side bracket assemblies 21, 22 as the bottom frame 11 and the top frame 12 rotate between the folded position and the unfolded position.

The mattress foundation 10 may be vertically adjustable in the unfolded position, e.g., at the time of initial installation and/or after initial installation. Specifically, the mattress foundation 10 may be raised and lowered between a raised position (e.g., FIGS. 1 and 2) and a lowered position (e.g., FIGS. 3 and 4). In such examples, the mattress foundation 10 may be repeatedly adjustable from one of the raised position and lowered position to the other of the raised position and lowered position as selected by a user, as described further below, i.e., in the example shown in the figures, the mattress foundation 10 can be selectively retained in the selected raised position/lowered position but is not permanently set in the selected raised position/lowered position and can be selectively raised/lowered with the structure and process described below. When in the folded position and the lowered position, the mattress foundation 10 has a decreased shipping dimension to reduce shipping and storage costs.

Figure 2:
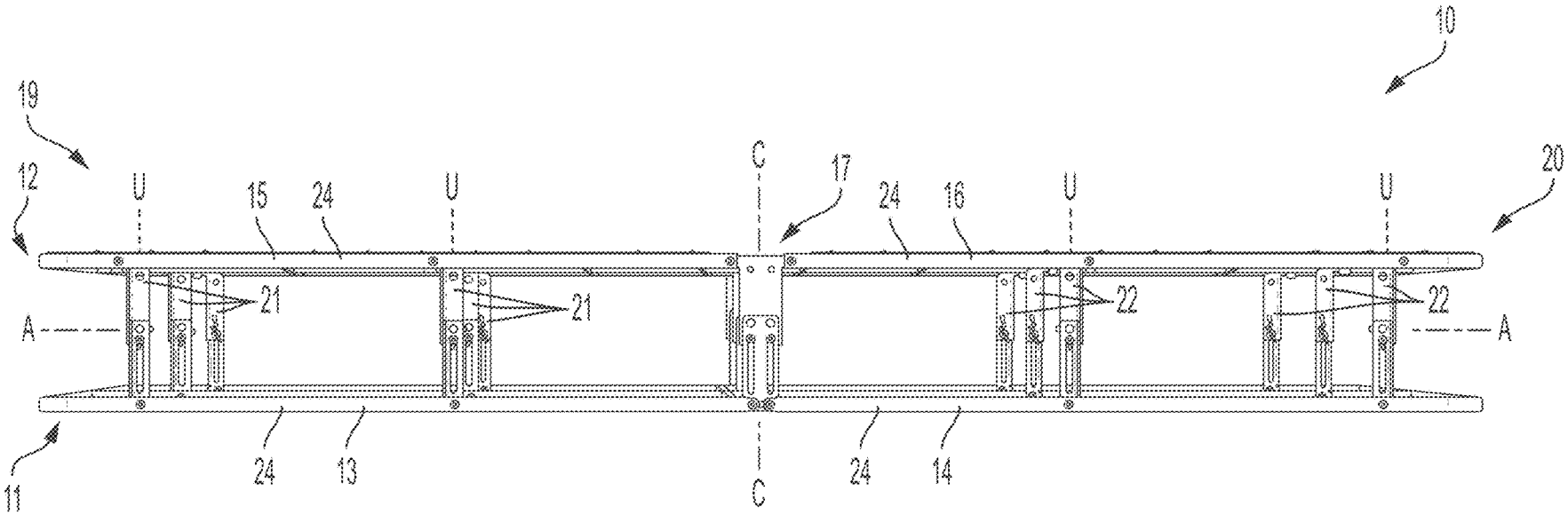
FIG. 2 is a side view of the mattress foundation of FIG. 1.
Figure 3:
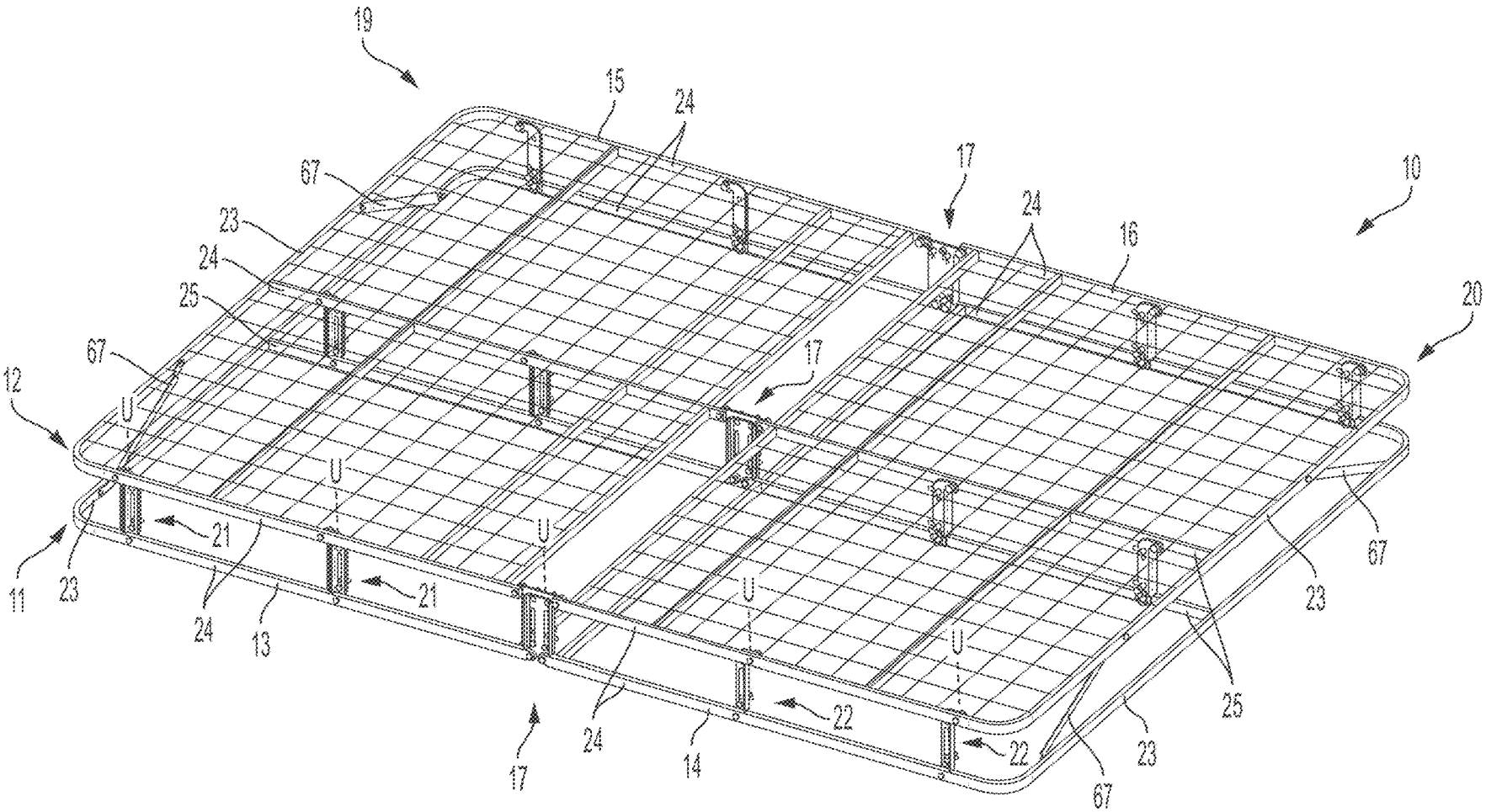
FIG. 3 is a perspective view of a mattress foundation in an unfolded position and a lowered position.
Figure 4:
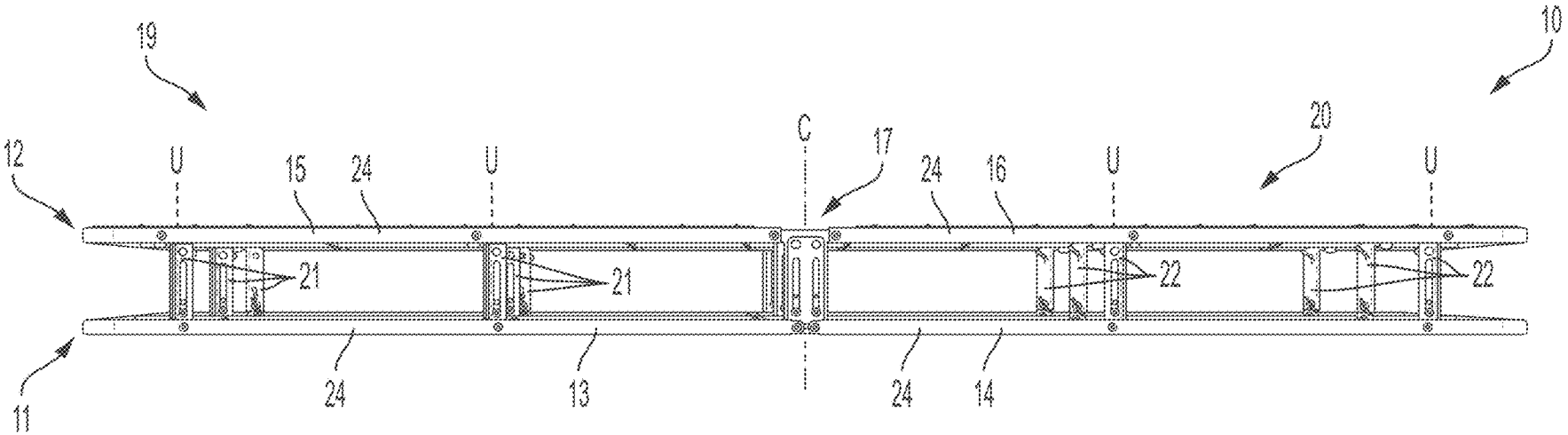
FIG. 4 is a side view of the mattress foundation of FIG. 3.
Figure 5:
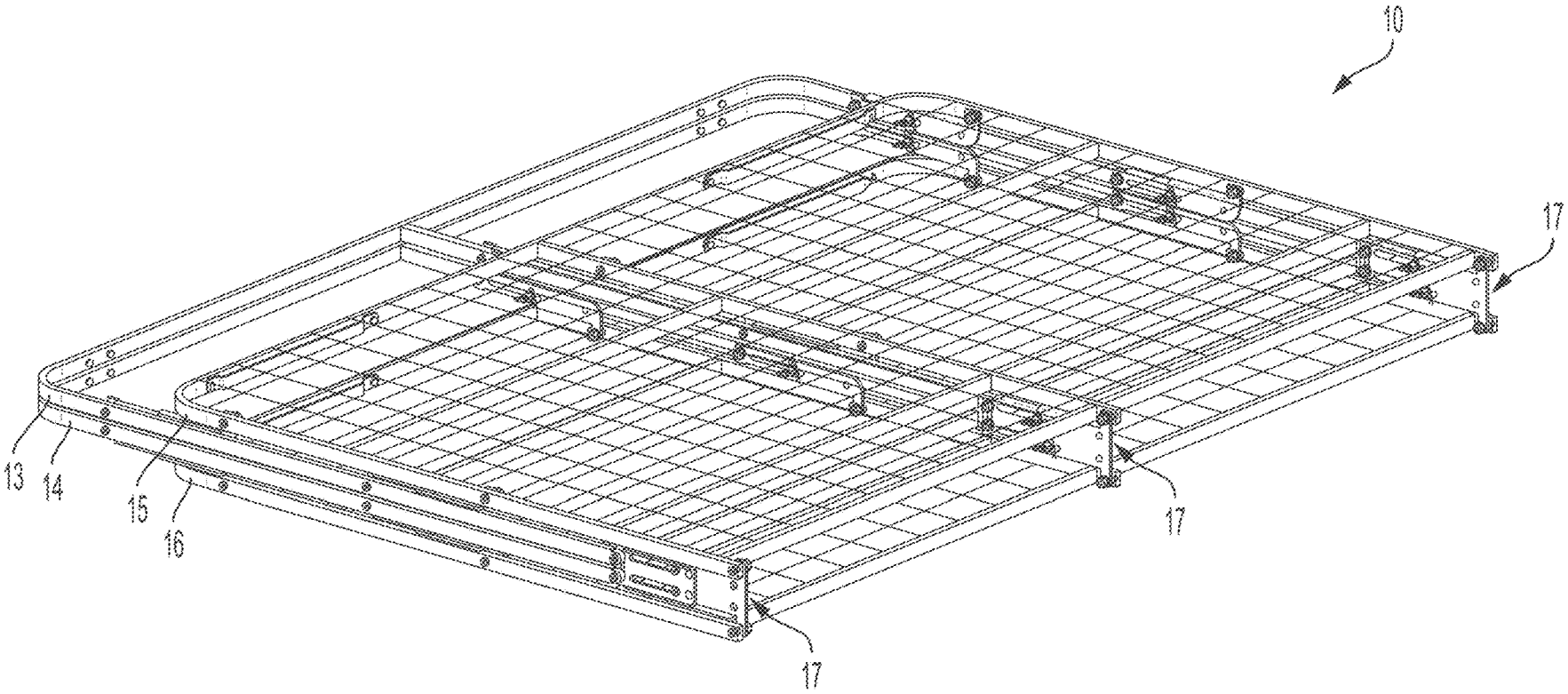
FIG. 5 is a perspective view of the mattress foundation in a folded position.

In some examples, the mattress foundation 10 may be vertically adjustable to one or more intermediate positions between the raised position and the lowered position. As one example, examples of the middle bracket assembly 17 and the side bracket assembly 21, 22 providing adjustment between the lowered position, one or more intermediate positions, and the raised position is shown in FIGS. 14A-15B, as described further below. In the examples in FIGS. 14A-15B, the mattress foundation 10 is adjustable to one intermediate position between the lowered position and the raised position and in other examples the mattress foundation 10 may be adjustable to more than one intermediate position between the lowered position and the raised position, as described further below. FIGS. 2 and 3 show the mattress foundation 10 at the raised position and FIGS. 4 and 5 show the mattress foundation 10 at the lowered position, as described further below. The raised position may be referred to, for example, as a standard height and the lowered position may be referred to, for example, as a low-profile height.

In the unfolded position, the mattress foundation 10 has a first axis A, a second axis B, and a vertical axis C. In the examples shown in the figures, the mattress foundation 10 is elongated along the first axis A, i.e., the longest dimension of the mattress foundation 10 is along the first axis A. In such examples, the first axis A is also referred to as the longitudinal axis A and the second axis is referred to as the lateral axis B. In such an example, the mattress foundation 10 folds about the lateral axis B between the folded position and the unfolded position. In other examples, the mattress foundation 10 may be elongated along the second axis B as labeled in the figures. In such an example, the mattress foundation 10 folds about the longitudinal axis A between the folded position and the unfolded position. The first axis A is centered on the mattress foundation 10. The second axis B is perpendicular to the first axis A. The second axis B is centered on the mattress foundation 10. The second axis B and the first axis A are horizontal or generally horizontal. The vertical axis C is perpendicular to the lateral axis B and the first axis A. The bottom frame 11 and the top frame 12 are spaced from each other along the vertical axis C in the unfolded position. The vertical axis Cis vertical or generally vertical in the unfolded position when the first bottom segment 13 and the second bottom segment 14 are on level ground.

In the unfolded position, the bottom frame 11 is below the top frame 12. Specifically, the first bottom segment 13 and the second bottom segment 14 are below the first top segment 15 and the second top segment 16 in the unfolded position. In the unfolded position, the top frame 12 is supported on the bottom frame 11, i.e., the weight of the top frame 12 is borne by the bottom frame 11. Specifically, the first top segment 15 may be supported by the first bottom segment 13 and the second top segment 16 may be supported by the second bottom segment 14. In use, the bottom frame 11 may be, for example, supported directly on ground, e.g., a floor, or indirectly on ground, e.g., through legs 71 as described further below. The bottom frame 11 may abut ground or may be spaced from ground by the legs 71.

The first segments 13, 15 and the second segments 14, 16 may each include one or more beams. The beams may be, for example, extruded or in other examples may manufactured in any suitable way. The beams may be, for example, metal or in other examples may be of any suitable material. Each of the first segments and the second segments may have any suitable numbers of beams. In the case of the foundation designed to support larger mattresses, such as a king mattress or a California king mattress, the first segment 13, 15 and the second segment 14, 16 may both have a larger number of beams, e.g., an equal number of beams, for support. In examples in which any of the segments include more than one beam, the beams of that segment 13, 14, 15, 16 may be fixed to each other in any suitable way, e.g., unitary formation, welding, fasteners, brackets, etc. In the examples shown in the figures, the first bottom segment 13 is identical to the second bottom segment 14 (and arranged as mirror images) and the first top segment 15 is identical to the first top segment 15 (and arranged as mirror images).

In the examples shown in the figures, the first bottom segment 13, the second bottom segment 14, the first top segment 15, and the second top segment 16 each include a U-shaped beam bent in a U-shape with ends of the "U" rotatably connected with two middle bracket assemblies 17, respectively. Specifically, with reference to FIGS. 1-4, the U-shape includes a base beam 23 elongated along the second axis B and two leg beams 24 elongated along the first axis A from the base beam 23 to the respective middle bracket assembly 17. The U-shaped beam may be bent into the U-shape at the intersection of the base beam 23 and the leg beams 24. The first segments and second segments may include a middle beam 25 elongated along the first axis A from the base beam 23 to one of the middle bracket assemblies 17. The first bottom segment 13 and second bottom segment 14 may include inboard beams 26 each elongated along the second axis B and extending from the middle beam 25 to one of the leg beams 24. The first segments and the second segments of the bottom frame 11 and the top frame 12 may include inboard beams 26 extending from the respective middle beam 25 near the middle bracket assemblies 17. The first top segment 15 and the second top segment 16 may include additional inboard segments spaced from each other along the first axis A, as shown in the example in the figures.

The first top segment 15 and the second top segment 16 may include a mesh (not numbered). The mesh is supported on at least one of the U-shaped beam, middle beam 25, and/or inboard beams 26. The mesh may be fixed, e.g., by welding, fastener, hook etc., to at least one of the U-shaped beam (e.g., the base beam 23 and/or the leg beams 24), middle beam 25, and/or inboard beams 26 of the respective first segment and second segment. The mesh may be, for example, metal or any other suitable material. In other examples, the first top segment 15 and the second top segment 16 may not include mesh. In such examples, the first top segment 15 and the second top segment 16 may include a suitable number of beams to support a mattress.

The top frame 12 and the bottom frame 11 are both elongated along the longitudinal axis A, as set forth above. Specifically, the first bottom segment 13, the second bottom segment 14, the first top segment 15, and the second top segment 16 may each be elongated along the longitudinal axis A.

The first bottom segment 13 and the second bottom segment 14 are coplanar in the unfolded position and the first top segment 15 and the second top segment 16 are coplanar in the unfolded position. Specifically, the first bottom segment 13 and the second bottom segment 14 are in a common plane that is parallel to the longitudinal first A and the second axis B and the first top segment 15 and the second top segment 16 are in a common plane that is parallel to the first axis A and the second axis B. In other words, the longest dimension and the second longest dimension of the first bottom segment 13 and the second bottom segment 14 are in a common plane such that the first bottom segment 13 and the second bottom segment 14 are flat in that common plane. Similarly, the longest dimension and second longest dimension of the first top segment 15 and the second top segment 16 are in a common plane such that the first top segment 15 and the second top segment 16 are flat in that common plane. The plane in which the first top segment 15 and the second top segment 16 are in is spaced above the plane in which the first bottom segment 13 and the second bottom segment 14 are in.

The first top segment 15, the second top segment 16, the first bottom segment 13, and the second bottom segment 14 are in parallel planes in the folded position. Specifically, the respective planes are spaced from each other and parallel with each other. In the folded position, the first bottom segment 13 and the second bottom segment 14 may abut each other, and the first top segment 15 may abut the first bottom segment 13 and the second top segment 16 may abut the second bottom segment 14 with the bottom segments 13, 14 sandwiched between the top segments 15, 16, as shown in the example in the figures. In other examples, in the folded position, the first top segment 15 and the second top segment 16 may abut each other, and the first bottom segment 13 may abut the first top segment 15 and the second bottom segment 14 may abut the second top segment 16 with the top segments 15, 16 sandwiched between the bottom segments 13, 14.

Figure 6:
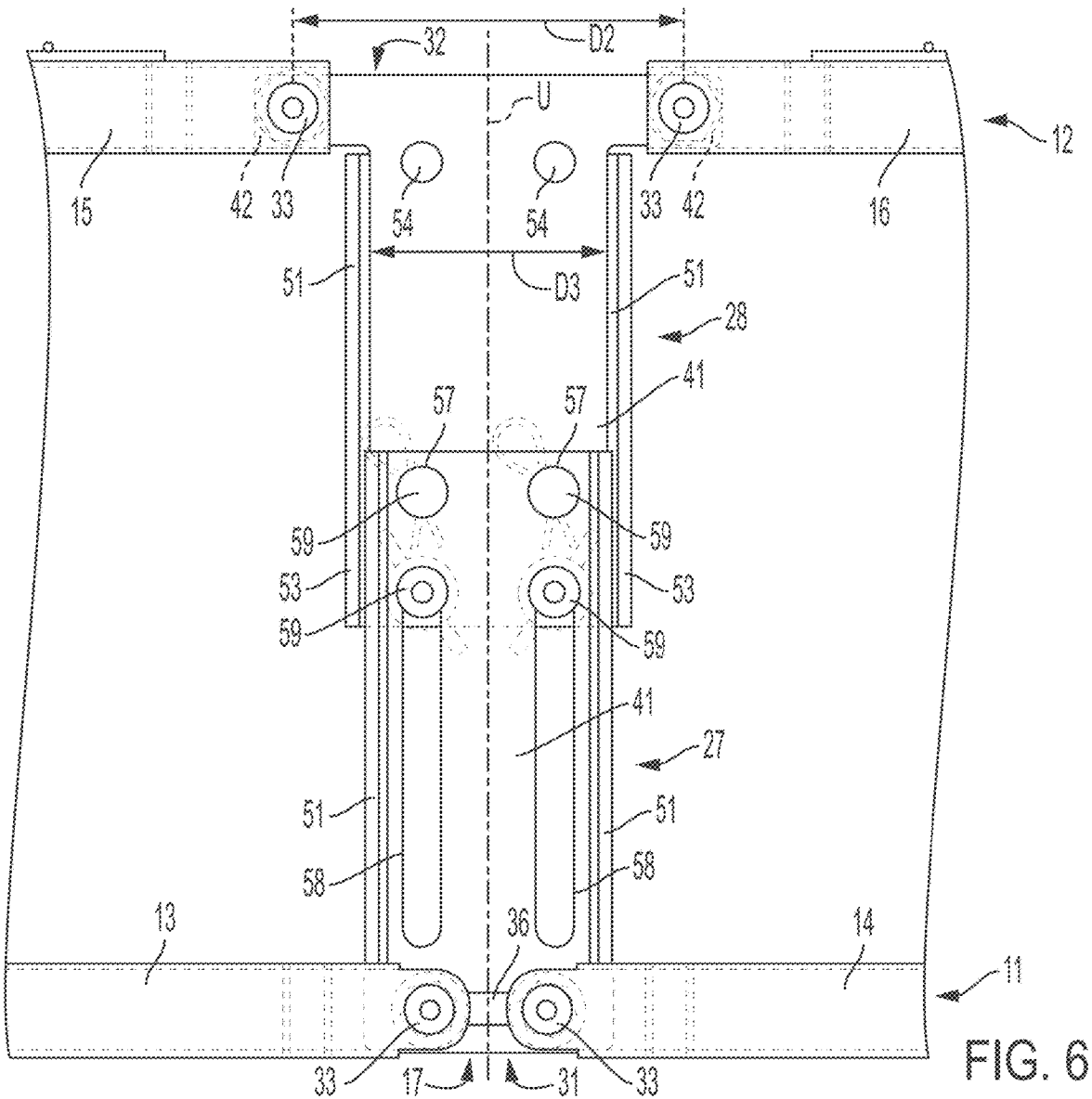
FIG. 6 is a side view of an example of a middle bracket assembly when the mattress foundation is in the unfolded position and the raised position.
Figure 7:
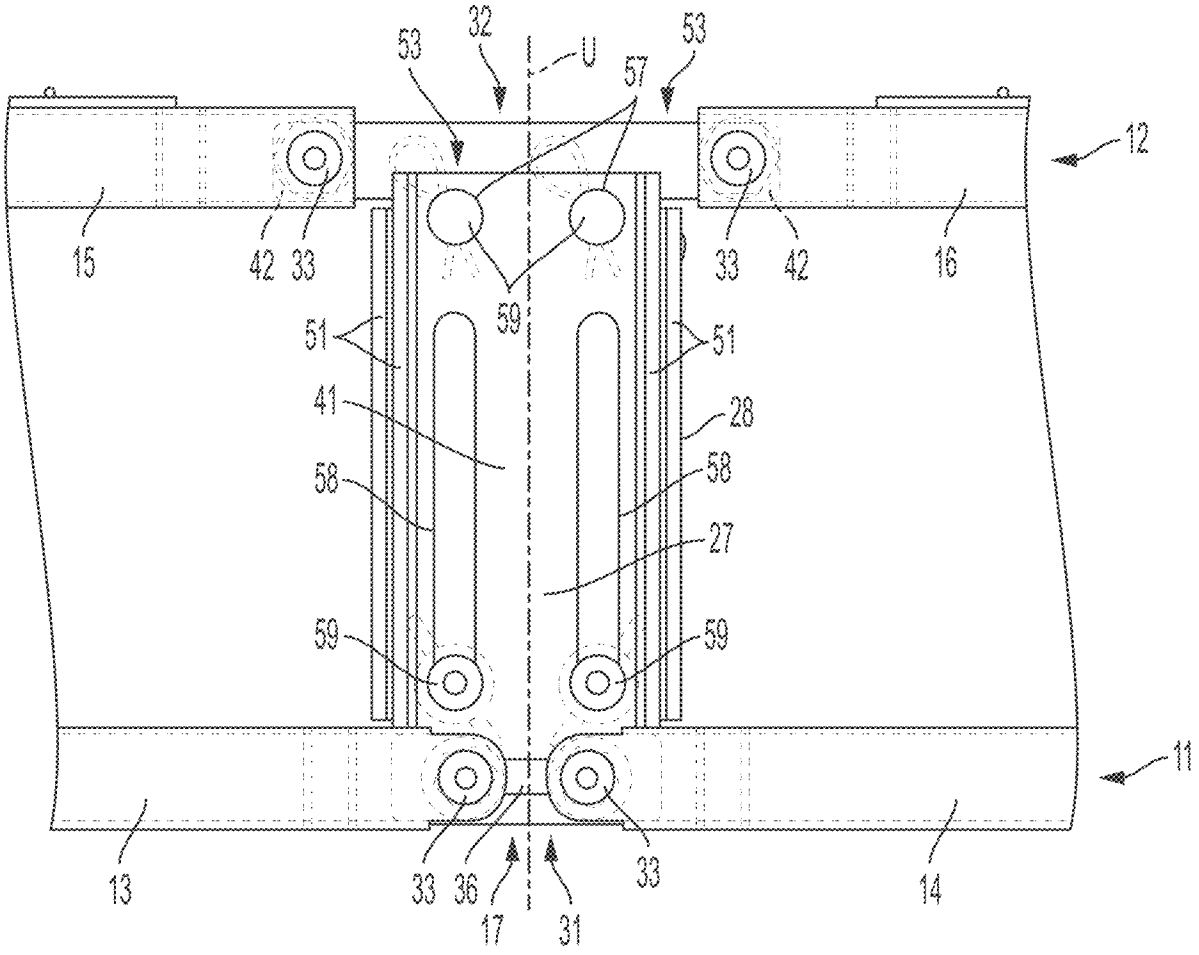
FIG. 7 is a side view of the middle bracket assembly of FIG. 6 when the mattress foundation is in the unfolded position and the lowered position.

Each bracket assembly includes at least one bracket and a plurality of fasteners rotatably connecting the top and bottom frame 11 to the bracket. In the examples shown in the figures, the bracket assemblies include two brackets that are adjustable relative to each other along the vertical axis C. Specifically, with reference to FIGS. 6, 7, and 10, each middle bracket assembly 17 includes a first bracket and a second bracket (hereinafter "first middle bracket 27" and "second middle bracket 28," respectively) and, with reference to FIGS. 8, 9, and 11, each side bracket includes a first bracket and a second bracket (hereinafter "first side bracket 29" and "second side bracket 30," respectively). In other examples, each bracket assembly may include one unitary bracket that connects to both the bottom frame 11 and the top frame 12, e.g., in examples in which the mattress foundation 10 is not vertically adjustable. The bracket assemblies may be metal or any other suitable material.

Each of the middle bracket assemblies 17 may be identical to each other, as shown in the example in the figures. In other examples, the middle bracket assemblies 17 may vary from each other. Each of the first side bracket assemblies 21 and second side bracket assemblies 22 may be mirror images of each other and otherwise identical to each other, as shown in the examples in the figures. In other examples, the first side bracket assemblies 21 and the second side bracket assemblies 22 may be identical to each other. In other examples, the first side bracket assemblies 21 may vary from each other, the second side bracket assemblies 22 may vary from each other, and/or the some or all of the first side bracket assemblies 21 may vary from some or all of the second side bracket assemblies 22.

The middle bracket assemblies 17 are between the first side 19 and the second side 20 along the first axis A, e.g., the longitudinal axis A. Specifically, the middle bracket assemblies 17 are between the first bottom segment 13 and the second bottom segment 14 along the first axis A, e.g., the longitudinal axis A and the middle bracket assemblies 17 are between the first top segment 15 and the second top segment 16 along the first axis A, e.g., the longitudinal axis A. The middle bracket assemblies 17 are spaced from each other along the second axis B, e.g., the lateral axis B. In the unfolded position, the middle bracket assemblies 17 may be elongated along the vertical axis C, as shown in the example in the figures. The first side 19 extends in in direction from the middle bracket assemblies 17 along the first axis A and the second side 20 extends in an opposite direction from the middle bracket assemblies 17 along the first axis A. The second axis B extends through the middle bracket assemblies 17 between the first side 19 and the second side 20.

All of the first side bracket assemblies 21 are spaced from the middle bracket assemblies 17 in one direction along the first axis A and all of the second side brackets 30 being spaced from the middle bracket assemblies 17 in an opposite direction along the first axis A. The first side brackets 29 may be spaced from each other along the first axis A and the second axis B, as shown in the example in the figures. Similarly, the second side brackets 30 may be spaced from each other along the first axis A and the second axis B, as shown in the example in the figures. In the examples shown in the figures, the middle bracket assemblies 21 are between the first side 19 and the second side 20 with the first side 19 extending a distance in one direction along the axis first axis A and the second side 20 extending the same distance in the opposite direction along the axis A.

The middle bracket assemblies 17 may be elongated perpendicular to the elongation of the top frame 12 and the bottom frame 11 in the unfolded position and may be elongated parallel to the elongation of the segments 13, 14, 15, 16 of the frames 11, 12 in folded position, as shown in the example in the figures. The side bracket assemblies 21, 22 may be elongated perpendicular to the elongation of the top frame 12 and the bottom frame 11 in the unfolded position and may be elongated transverse to and not perpendicular to the respective segments 13, 14, 15, 16 of the frames 11, 12 in the folded position, as shown in the example in the figures.

Each bracket assembly has a bottom end 31 and a top end 32. The bottom end 31 is below the top end 32 along the vertical axis C in the unfolded position. In examples in which the bracket assemblies include two brackets, for each middle bracket assembly 17, one of the first middle bracket 27 and the second middle bracket 28 includes the bottom end 31 and the other of the first middle bracket 27 and the second middle bracket 28 includes the top end 32. Similarly, for each side bracket, one of the first side bracket 29 and the second side bracket 30 includes the bottom end 31 and the other of the first side bracket 29 and the second side bracket 30 includes the top end 32. In the example shown in the figures, each first middle bracket 27 and first side bracket 29 includes the bottom end 31 and each second middle bracket 28 and second side bracket 30 includes the top end 32. In other words, in the example shown in the figures, the first middle bracket 27 is below the second middle bracket 28 and the first side bracket 29 is below the second side bracket 30. Specifically, the first bottom segment 13 and the second bottom segment 14 are rotatably connected to the first middle bracket 27 and respective first side brackets 29 and the first top segment 15 and the second top segment 16 are rotatably connected to the second middle bracket 28 and respective second side brackets 30.

Figure 10:
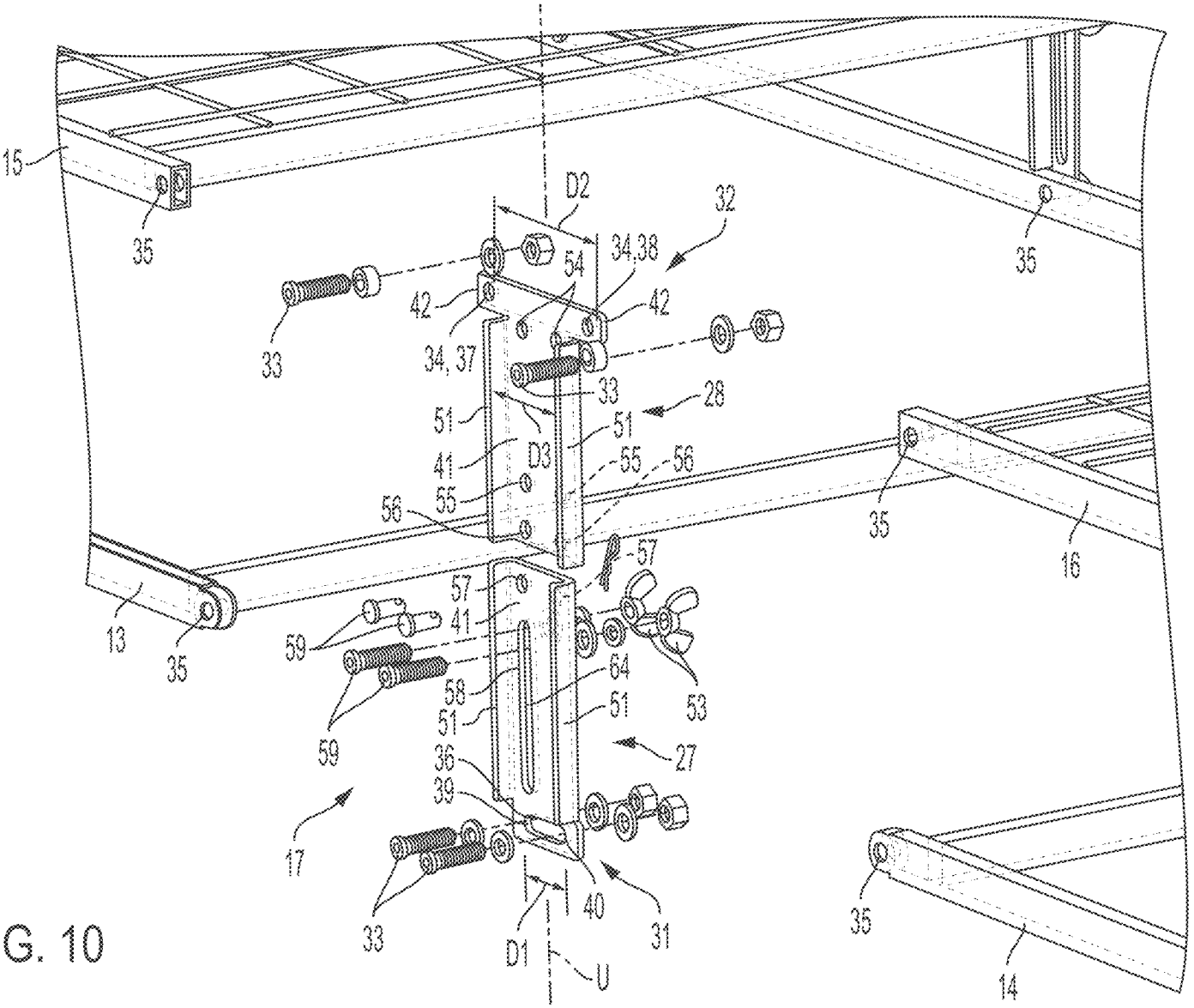
FIG. 10 is an exploded view of the mattress foundation at one of the middle bracket assemblies.

The middle bracket assemblies 17 and the side bracket assemblies 21, 22 include a plurality of fasteners 33 and fastener-clearance holes 34 (FIG. 10). The fasteners 33 may be of any suitable type. In the examples shown in the figures, the fasteners 33 are threaded fasteners, specifically bolts threadedly engaged with nuts. In other examples, the fasteners 33 may be of any suitable type including rods, pins, etc. The first bottom segment 13, the second bottom segment 14, the first top segment 15, and the second top segment 16 each have segment holes 35 that receive the respective fastener. The fasteners 33 may extend through the respective fastener-clearance holes 34 and segment holes 35, as shown in the examples in the figures.

The fastener-clearance holes 34 and the fasteners 33 are sized for a clearance fit therebetween. The clearance fit allows the fastener-clearance hole 34 to receive the respective fastener 33 with clearance between the fastener 33 and the fastener-clearance hole 34 to allow axial insertion of the fastener 33 into the fastener-clearance hole 34 without significant translation of the fastener 33 in the fastener-clearance hole 34 in a direction transverse to the axis of the fastener 33. Specifically, the fit between the fastener 33 and the fastener-clearance hole 34 can be a loose running fit, a free running fit, a close running fit, a sliding fit, or a locational clearance fit. The segment holes 35 may be sized to have a fastener clearance size and shape to receive the fastener 33 with a clearance fit therebetween. In the examples shown in the figures, the fastener-clearance holes 34 and the segment holes 35 are circular and the fasteners 33 have a circular cross-section sized to have a clearance fit with the fastener-clearance holes 34 and the segment holes 35.

In the example shown in the figures, the mattress foundation 10 includes three middle bracket assemblies 17. In other examples, the mattress assembly may include two middle bracket assemblies 17 or more than three middle bracket assemblies 17. Each middle bracket assembly 17 is between the first side 19 and the second side 20. Specifically, each middle bracket assembly 17 may be in the middle of the first side 19 and the second side 20 along the first axis A (e.g., the longitudinal axis A), as shown in the example shown in the figures. The middle bracket assemblies 17 may be centered on the mattress foundation 10 along the first axis A, i.e., on the second axis B.

Each middle bracket assembly 17 has an upright axis U. The upright axes U are parallel to the vertical axis C of the mattress foundation 10 in the unfolded position. The top frame 12 and the bottom frame 11 are spaced from each other along the upright axis U in the unfolded position. Specifically, the first bottom segment 13 and the first top segment 15 are spaced from each other along the upright axes U and the second bottom segment 14 and second top segment 16 are spaced from each other along the upright axes U.

The middle bracket assemblies 17 connect the first top segment 15, the second top segment 16, the first bottom segment 13, and the second bottom segment 14. Specifically, in examples in which the middle bracket assemblies 17 each include the first middle bracket 27 and the second middle bracket 28, the first top segment 15 and the second top segment 16 are connected to one of the first middle bracket 27 and the second middle bracket 28, and the first bottom segment 13 and the second bottom segment 14 are connected to the other of the first middle bracket 27 and the second middle bracket 28. In the example shown in the figures, for example, the first bottom segment 13 and the second bottom segment 14 are connected to the first middle bracket 27, and the first top segment 15 and the second top segment 16 are connected to the second middle bracket 28.

The bottom frame 11 or the top frame 12 is rotatably connected to the middle bracket assembly 17 at pivoting hinges, i.e., with only rotational movement of the frame allowed at the pivoting hinges, and the other of the bottom frame 11 or the top frame 12 is rotatably connected to the middle bracket assembly 17 at a floating hinge that allows both rotational movement and translational movement of the frame. Specifically, each pivoting hinge includes a fastener-clearance hole 34 and a fastener 33 engaged with the fastener-clearance hole 34. The floating hinge includes a slot 36 and fasteners 33 engaged with the fastener-clearance hole 34. In the example shown in the figures, the slot 36 is at the bottom end 31 of the middle bracket assembly 17 and the fastener-clearance holes 34 are at the top end 32 of the middle bracket assembly 17. Specifically, in the example shown in the figure, the slot 36 is on the first middle bracket 27 and the fastener-clearance holes 34 are on the second middle bracket 28. In other examples, the slot 36 may be at the top end 32 of the middle bracket assembly 17, e.g., on the second middle bracket 28, and the fastener-clearance holes 34 may be at the bottom end 31 of the middle bracket assembly 17, e.g., on the first middle bracket 27.

Each middle bracket assembly 17 includes a first fastener-clearance hole 34, 37 and a second fastener-clearance hole 34, 38 spaced from each other along the first axis A, e.g., the longitudinal axis A (FIG. 10). The first fastener-clearance hole 34, 37 and the second fastener-clearance hole 34, 38 are on opposite sides of the upright axis U. Specifically, the first fastener-clearance hole 34, 37 and the second fastener-clearance hole 34, 38 may be equidistantly spaced from the upright axis U along a line perpendicular to the upright axis U, as shown in the example in the figures.

The first segment of the second frame is rotatably connected to the first fastener-clearance hole 34, 37 and the second segment of the second frame is rotatably connected to the second fastener-clearance hole 34, 38. For example, in the example in the figures, the first top segment 15 is rotatably connected to the first fastener-clearance hole 34, 37 and the second top segment 16 is rotatably connected to the second fastener-clearance hole 34, 38.

The slot 36 of the middle bracket assembly 17 is elongated along the first axis A (e.g., the longitudinal axis A), i.e., the longest dimension of the slot 36 is along the first axis A. The first segment of the first frame and the second segment of the first frame are rotatably connected to the slot 36 and are both slidable along the slot 36 along the first axis A. For example, in the example in the figures, the first bottom segment 13 and the second bottom segment 14 are rotatably connected to the slot 36 and are both slidable along the slot 36 along the first axis A.

The middle bracket assemblies 17 each include four fasteners 33 rotatably connecting the first bottom segment 13, the second bottom segment 14, the first top segment 15, and the second top segment 16, respectively, to the bracket. The first bottom segment 13, the second bottom segment 14, the first top segment 15, and the second top segment 16 are rotatably connected to the middle bracket assembly 17 in that the respective segment can rotate about the respective fastener 33 between the folded position and the unfolded position. The first bottom segment 13, the second bottom segment 14, the first top segment 15, and the second top segment 16 each have segment holes 35 that receive the respective fastener 33.

The slot 36 is elongated along the first axis A, e.g., the longitudinal axis A, with a length along the first axis A to receive two fasteners 33 and allow both fasteners 33 to slide in the slot 36 along the first axis A. The slot 36 and the fasteners 33 are sized so that the fasteners 33 do not have significant movement in the slot 36 along the upright axis U. For example, the slot 36 and the fasteners 33 have a fastener-clearance fit along the upright axis U. The slot 36 is elongated along the first axis A from a first end 39 to a second end 40 (FIG. 10). The first end 39 and the second end 40 are spaced from each other by a distance D1 (FIG. 10). The distance D1 is more than the sum of the diameters of the fasteners 33 in the slot 36 (e.g., FIG. 6). When the fasteners 33 are in the slot 36, the fasteners 33 can be moved in the slot 36 to be spaced from each other, i.e., with a gap therebetween. This allows the first bottom segment 13 and the second bottom segment 14, in the example shown in the figures, to both slide and rotate between the folded position and the unfolded position. This, among other benefits, increases case of folding and unfolding the mattress foundation 10.

In the example shown in the figures, the first fastener-clearance hole 34, 37 and the second fastener-clearance hole 34, 38 are spaced from each other along the first axis A, e.g., the longitudinal axis A, by a distance D2 greater than the distance D1 between the first end 39 and the second end 40 of the slot 36 (e.g., FIG. 10).

The middle bracket assembly 17 may include a spine 41 elongated along the upright axis U and cars 42 extending from the spine 41 along the first axis A. The cars 42 may be aligned with each other along the upright axis U and extend from the spine 41 in opposite directions along the first axis A. The cars 42 may be equidistantly spaced from the upright axis U along a line perpendicular to the upright axis U, as shown in the example in the figures. The first fastener-clearance hole 34, 37 is on one of the cars 42 and the second fastener-clearance hole 34, 38 is on the other of the cars 42. The slot 36 is on the spine 41. In the example shown in the figures, the first middle bracket 27 and the second middle bracket 28 both define the spine 41 and the second middle bracket 28 includes the cars 42.

The bracket assemblies include first side bracket assemblies 21 connecting the first top segment 15 to the first bottom segment 13; and the bracket assemblies include second side bracket assemblies 22 connecting the second top segment 16 to the second bottom segment 14. In the example shown in the figures, the mattress foundation 10 includes six side bracket assemblies 21, 22 on each of the first side 19 and the second side 20. In other examples, the mattress assembly may include any suitable number of side bracket assemblies 21, 22.

The first side bracket assemblies 21 adjustably connect the first top segment 15 and the first bottom segment 13 for movement of the first top segment 15 toward and away from the first bottom segment 14 between the lowered position and the raised position. The second side bracket assemblies 22 adjustably connect the second top segment 16 and the second bottom segment 14 for movement of the second top segment 16 toward and away from the second bottom segment 14 between the lowered position and the raised position.

Each side bracket assembly 29, 30 has an upright axis U. The upright axes U are parallel to the vertical axis C of the mattress foundation 10 in the unfolded position. The top frame 12 and the bottom frame 11 are spaced from each other along the upright axis U in the unfolded position. Specifically, the first bottom segment 13 and the first top segment 15 are spaced from each other along the upright axes U of the first side 19 and the second bottom segment 14 and second top segment 16 are spaced from each other along the upright axes U of the second side 20.

The bottom frame 11 and the top frame 12 are rotatably connected to the side bracket assemblies 21, 22 at pivoting hinges, i.e., with only rotational movement of the frame allowed at the pivoting hinges. Specifically, each pivoting hinge includes a fastener-clearance hole 34 and a fastener 33 engaged with the fastener-clearance hole 34.

Each side bracket assembly 21, 22 includes a first fastener-clearance hole 45 and a second fastener-clearance hole 46. The first segment of the first frame is rotatably connected to the first fastener-clearance hole 45 of the first side bracket assembly 21 and the second segment of the first frame is rotatably connected to the second fastener-clearance hole 46 of the first side bracket assembly 21. The first segment of the second frame is rotatably connected to the first fastener-clearance hole 45 of the second side bracket assembly 22 and the second segment of the second frame is rotatably connected to the second fastener-clearance hole 46 of the second side bracket assembly 22. For example, in the example in the figures, the first bottom segment 13 is rotatably connected to the first fastener-clearance hole 45 of the first side bracket assembly 21 and the first top segment 15 is rotatably connected to the second fastener-clearance hole 46 of the first side bracket assembly 21. Similarly, in the example shown in the figures, the second bottom segment 14 is rotatably connected to the first fastener-clearance hole 45 of the second side bracket assembly 22 and the second top segment 16 is rotatably connected to the second fastener-clearance hole 46 of the second side bracket assembly 22.

The first side bracket assemblies 21 each include two fasteners 33 rotatably connecting the first bottom segment 13 and the first top segment 15. The second side bracket assemblies 22 each include two fasteners 33 rotatably connecting the second bottom segment 14 and the second top segment 16. The first bottom segment 13, the second bottom segment 14, the first top segment 15, and the second top segment 16 are rotatably connected to the respective side bracket assembly 21, 22 in that the respective segment can rotate about the respective fastener 33 between the folded position and the unfolded position. The first bottom segment 13, the second bottom segment 14, the first top segment 15, and the second top segment 16 each have segment holes 35 that receive the respective fastener 33.

Figure 16:
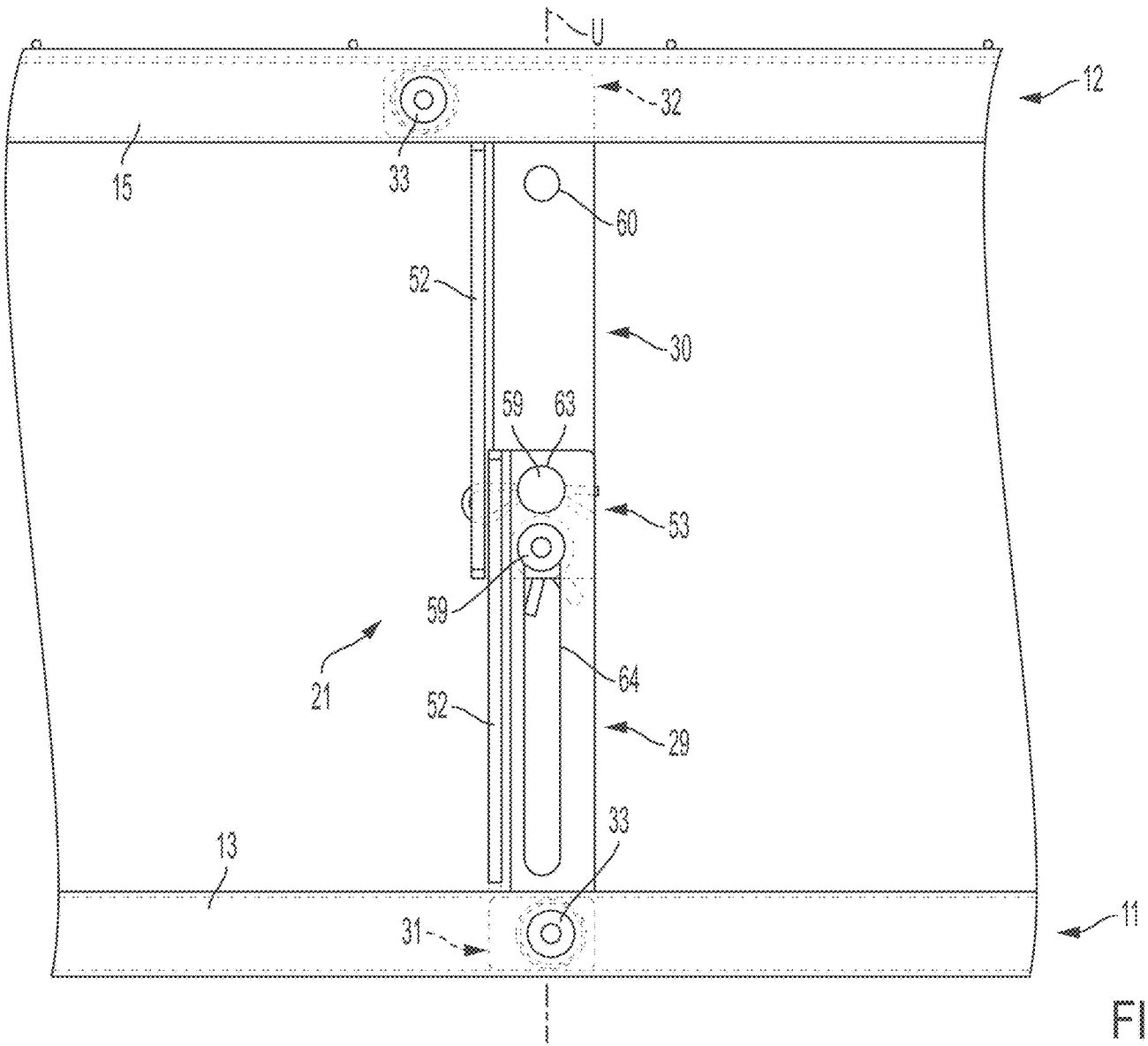
FIG. 16 is a side view of an example of the side bracket assembly when the mattress foundation is in the unfolded position and the raised position.
Figure 17:
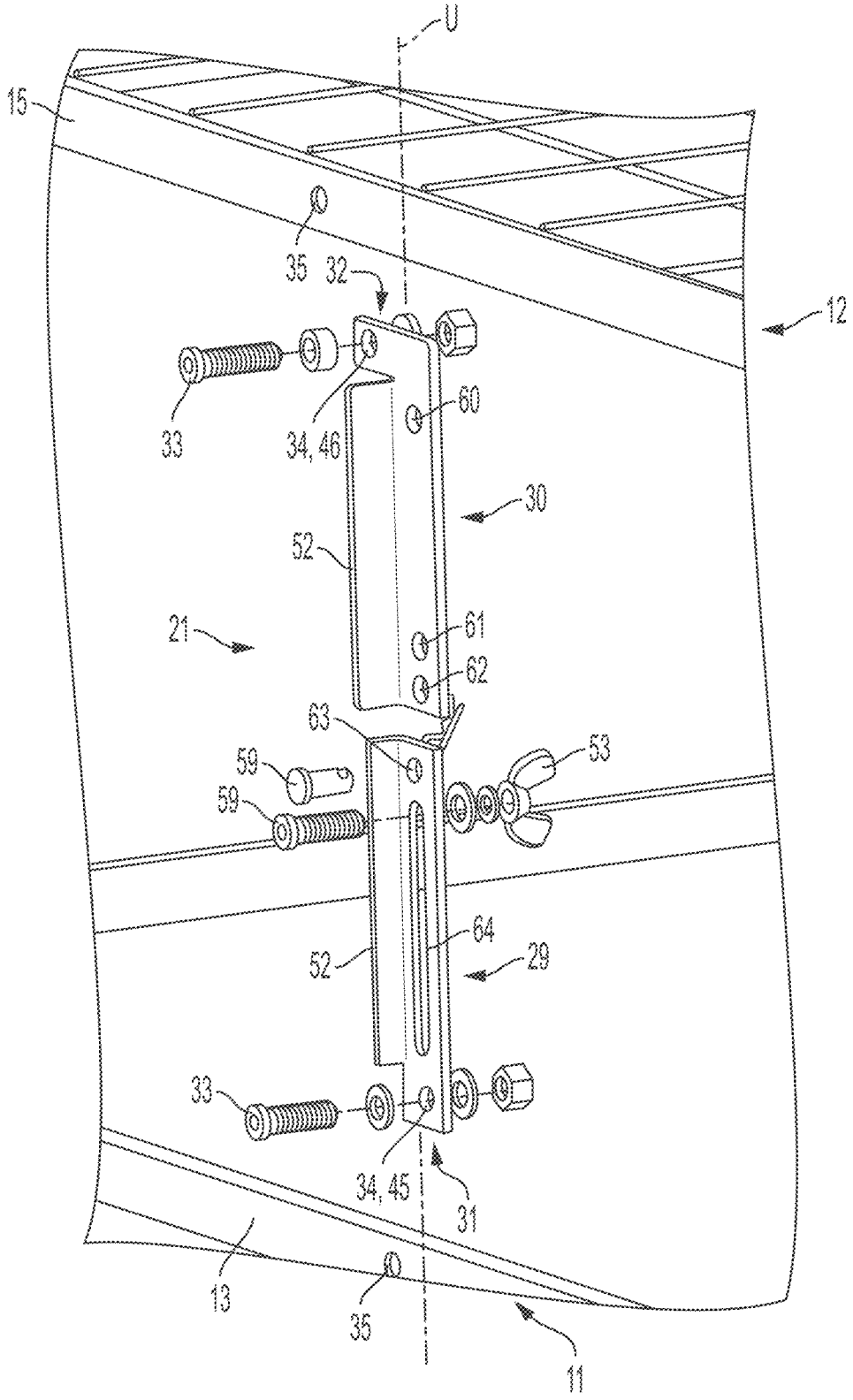
FIG. 17 is an exploded view of the mattress foundation at one of the side bracket assemblies with the example side bracket assembly of FIG. 16.

The first fastener-clearance hole 45 and the second fastener-clearance hole 46 are spaced from each other along the upright axis U and are offset from each other along the first axis A. For example, in the example shown in FIGS. 8, 9, and 11, the side bracket may be J-shaped, e.g., the first side bracket 29 and the second side bracket 30 in combination, is J-shaped. As another example, in the example shown in FIGS. 16-18, the side bracket assembly 21, 22 may be L-shaped.

Figure 8:
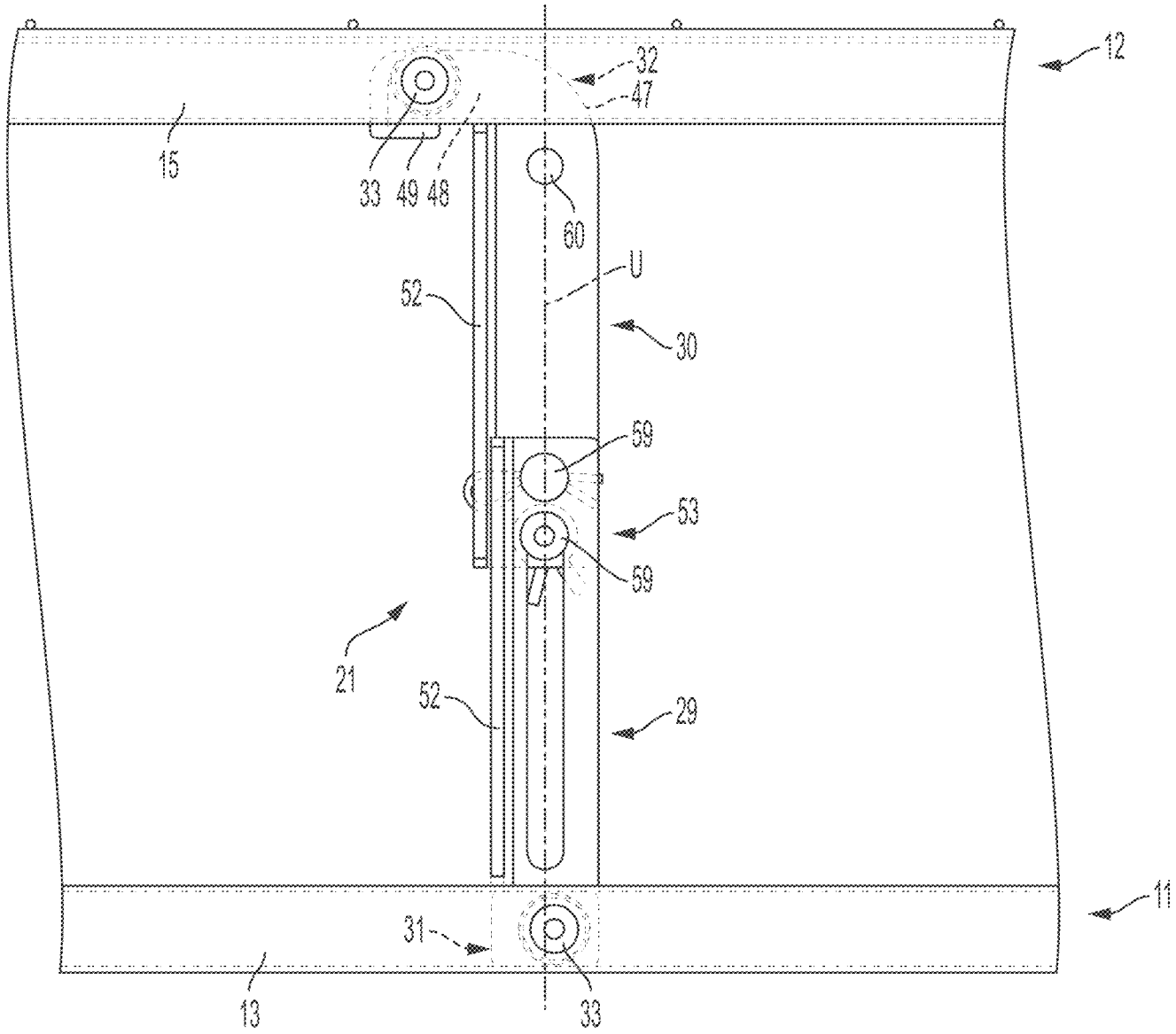
FIG. 8 is a side view of an example of a side bracket assembly when the mattress foundation is in the unfolded position and the raised position.
Figure 9:
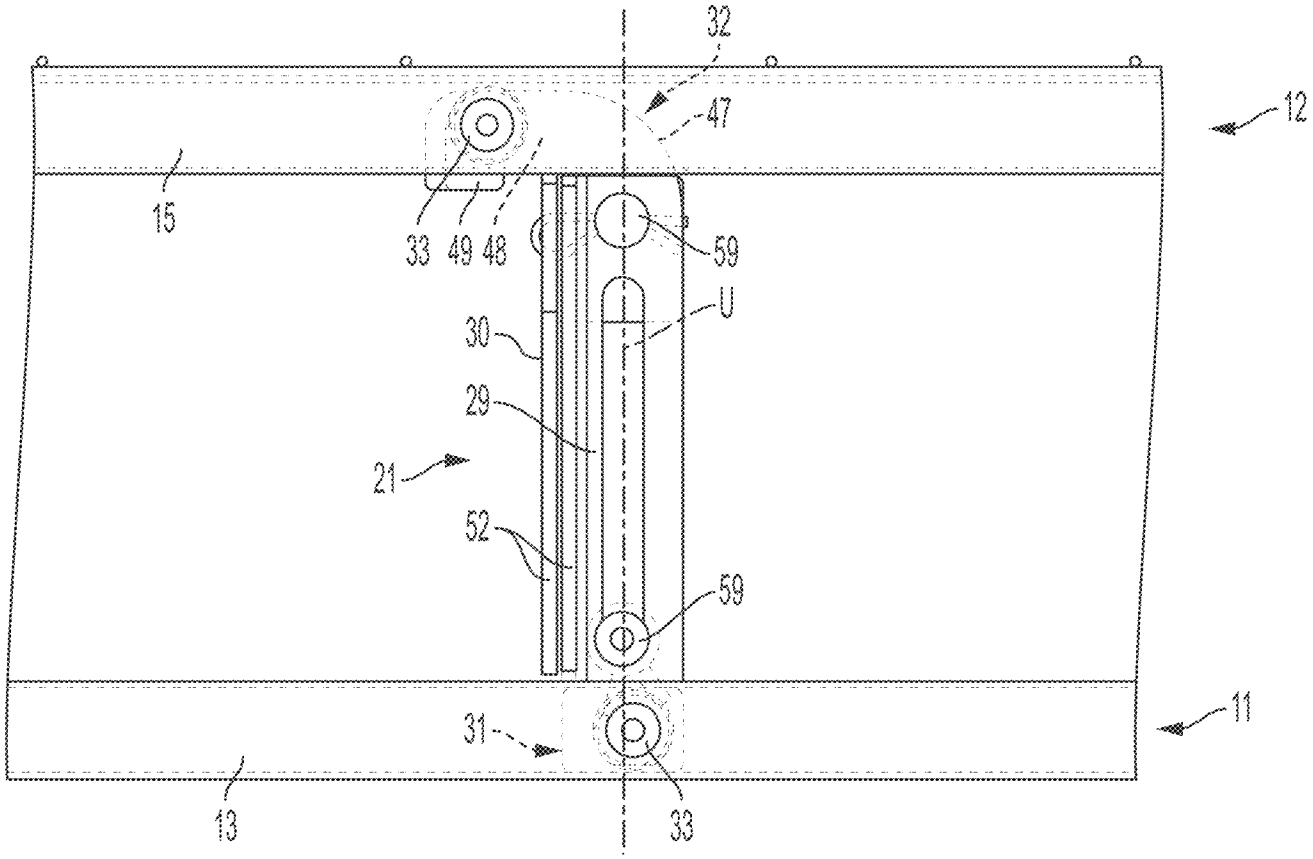
FIG. 9 is a side view of the side bracket assembly of FIG. 8 when the mattress foundation is in the unfolded position and the lowered position.
Figure 11:
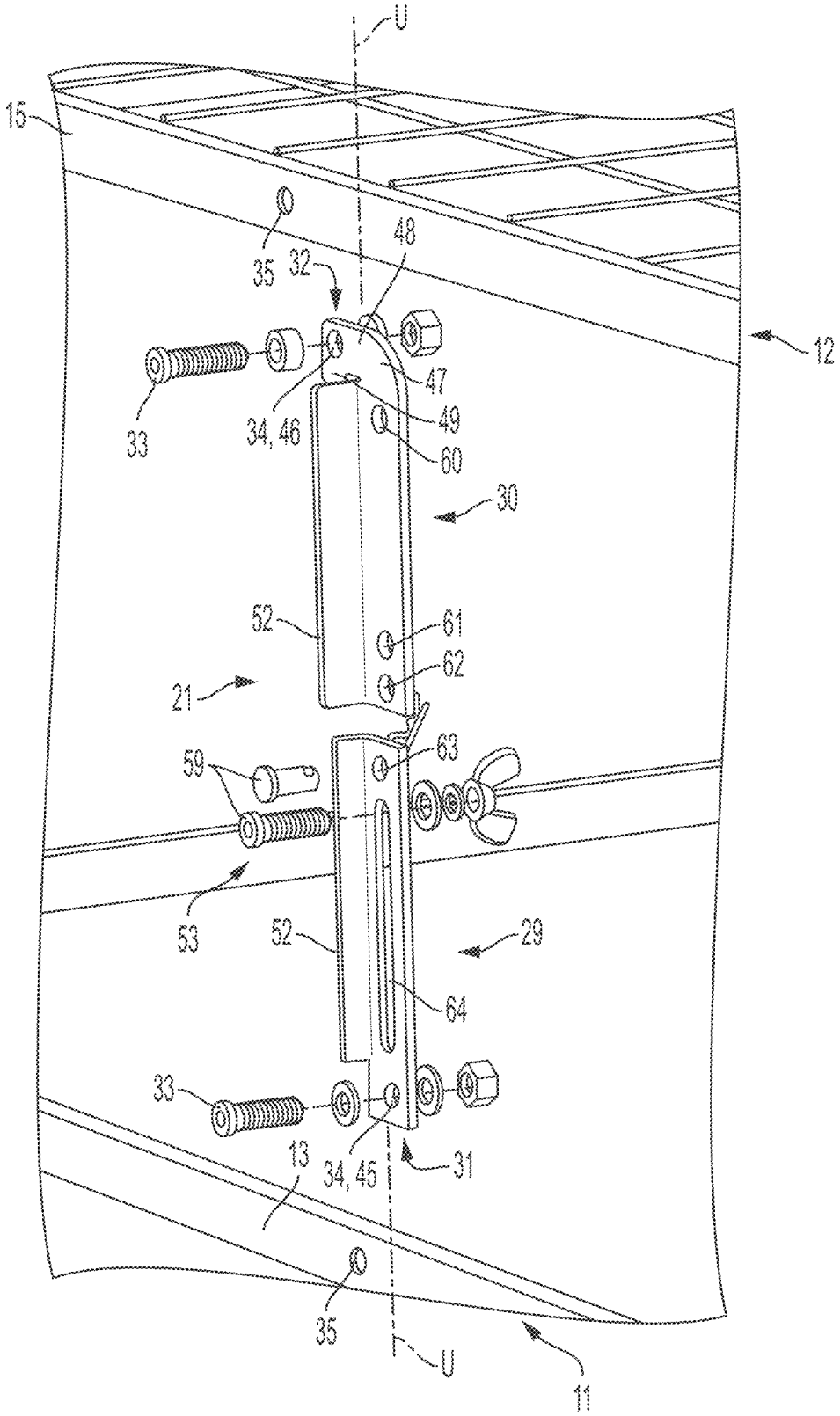
FIG. 11 is an exploded view of the mattress foundation at one of the side bracket assemblies.

With reference to the J-shaped side bracket assembly 21 shown in FIGS. 8, 9, and 11, in such an example, the second side bracket 30 extends upwardly from the first side bracket 30, arcuately turns horizontally at the top frame 12, and arcuately turns downwardly below the top frame 12. Specifically, the second side bracket 30 includes an arcuate elbow 47 at the top frame 12. The second bracket includes an extension 48 extending from the arcuate elbow 47 along the top frame 12 to the joint with the top frame 12. The second side bracket 30 may include a leg 49 extending downwardly from the extension 48 toward the bottom frame 11. The leg 49 may extend downwardly below a bottom surface of the top frame 12 in the unfolded position, as shown in FIGS. 8 and 9. The arcuate surface of the arcuate elbow 47 reduces intrusion points between the second side bracket 30 and the top frame 12 during rotation of the second side bracket 30 relative to the top frame 12 during movement of the mattress foundation 10 between the folded position and the unfolded position. The leg 49 strengthens the second side bracket 30. Specifically, the leg 49 increases material below the joint between the second side bracket 30 and the top frame 12, which increases the distribution of downward loads on the top frame 12. The J-shape of the second side bracket 30 improves efficiency of material usage.

Figure 18:
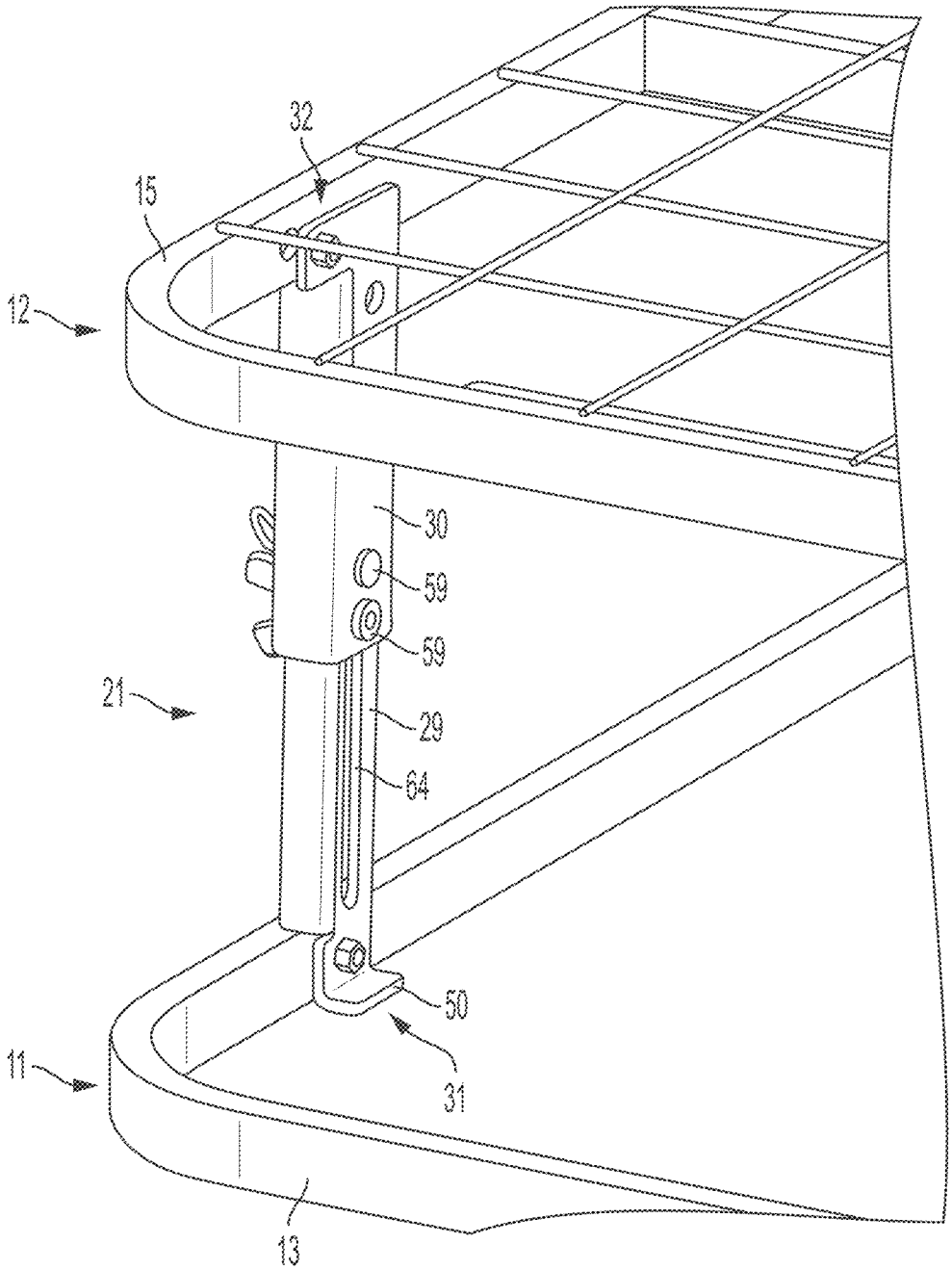
FIG. 18 is a perspective view of the mattress foundation with another example of the side bracket assembly.
Figure 20:
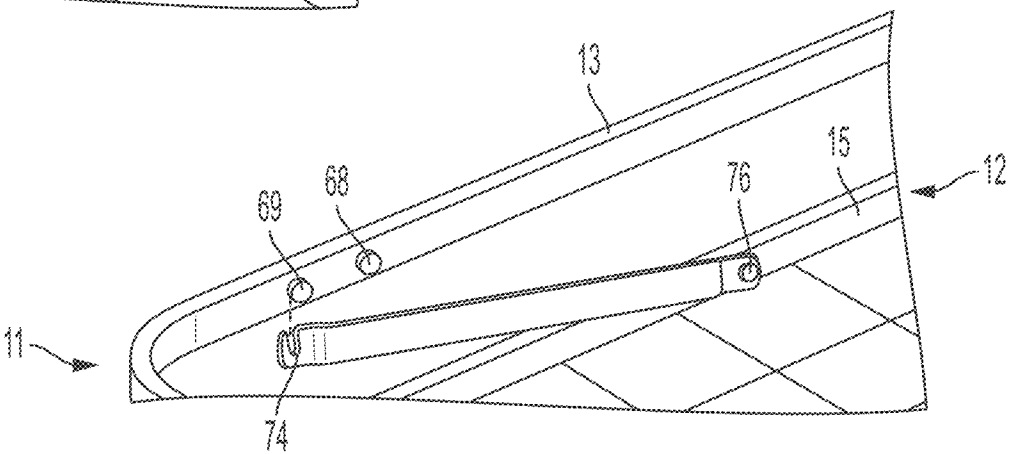
FIG. 20 is a perspective view of the mattress foundation with a latch arm positioned to engage a stud when the mattress foundation is in a lowered position.
Figure 19:
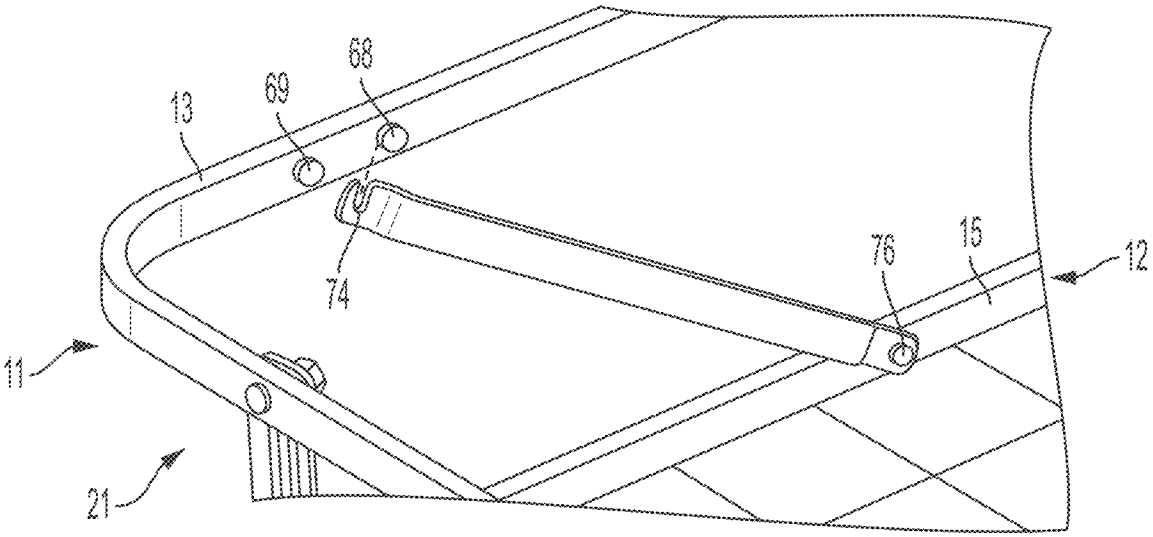
FIG. 19 is a perspective view of the mattress foundation with a latch arm positioned to engage a stud when the mattress foundation is in a raised position.

Another example of a side bracket assembly 21 is shown in FIG. 18. In that example, the side bracket includes a foot 50. The foot 50 extends transversely from the first side bracket 29 for resting on ground. For example, the foot 50 may be at a right angle relative to the upright axis U of the side bracket, e.g., the first side bracket 29. The foot 50 extends from a bottom end 31 of the first bracket. In the example shown in FIG. 18, the foot 50 may extend inboard from the first side bracket 29 relative to the mattress foundation 10 as a whole.

The foot 50 and the first side bracket 29 may be unitary, i.e., a single, uniform piece of material with no seams, joints, fasteners, or adhesives holding them together. For example, the foot 50 and the first side bracket 29 may be formed together simultaneously as a single continuous unit, e.g., by machining from a unitary blank, molding, forging, casting, etc. In such examples, the foot 50 may be bent relative to the first side bracket 29 to be transverse to the first side bracket 29. Non-unitary components, in contrast, are formed separately and subsequently assembled, e.g., by welding, bonding, adhesive, etc. It should be appreciated that the second side bracket 30 in FIG. 18 may be J-shaped as shown in the example in FIGS. 8-9, i.e., the foot 50 may be included in the examples of FIGS. 8-9 and/or the example shown in FIGS. 16-17.

Each middle bracket assembly 17 includes at least one flange 51 elongated along the upright axis U. In the example shown in the figures, each middle bracket assembly 17 includes two flanges 51 each elongated along the upright axis U. In such an example, each flange 51 extends perpendicularly from the spine 41. The flanges 51 abut the first frame or the second frame in the unfolded position. Specifically, in the example shown in the figures, the flanges 51 abut the bottom frame 11, i.e., the first bottom segment 13 and the second bottom segment 14. In the example shown in the figures, the first middle bracket 27 and the second middle bracket 28 both include the flanges 51, in which example the flanges 51 can nest with each other and abut each other.

The flanges 51 are spaced from each other along the first axis A, e.g., the longitudinal axis A. As shown in the example in the figures, the distance D1 between the first end and the second end of the slot 36 along the first axis A may be less than the distance D3 between the flanges 51 along the first axis A (e.g., FIG. 10). The distance D2 between the first fastener-clearance hole 34, 37 and the second fastener-clearance hole 34, 38 of the middle bracket assembly 17 along the first axis A may be greater than the distance D3 between the flanges 51 along the first axis A, as shown in the example in the figures.

Each side bracket assembly 21, 22 includes at least one flange 52 elongated along the upright axis U. In the example shown in the figures, each side bracket assembly 21, 22 includes one flange 51 elongated along the upright axis U. In such an example, the side bracket assembly 21, 22 includes a spine and the flange 52 extends perpendicularly from the spine. The flange 52 abuts the first frame or the second frame in the unfolded position. Specifically, in the example shown in the figures, the flanges 52 abut the bottom frame 11, i.e., the first bottom segment 13 or the second bottom segment 14. In the example shown in the figures, the first side bracket 29 and the second side bracket 30 both include the flanges 52, in which example the flanges 52 can nest with each other and abut each other.

Each bracket assembly adjustably connects the top frame 12 and the bottom frame 11 in the unfolded position for movement of the top frame 12 toward and away from the bottom frame 11 between the lowered position and the raised position. Specifically, the middle bracket assemblies 17 adjustably connect the first top segment 15 and the second top segment 16 to the first bottom segment 13 and the second bottom segment 14 in the unfolded position for movement of the first top segment 15 and the second top segment 16 toward and away from the first bottom segment 13 and the second bottom segment 14 between the lowered position and the raised position. Similarly, the first side bracket assemblies 21 adjustably connect the first bottom segment 13 to the first top segment 15 in the unfolded position for movement of the first top segment 15 toward and away from the first bottom segment 13 between the lowered position and the raised position. The second side bracket assemblies 22 adjustably connect the second bottom segment 14 to the second top segment 16 in the unfolded position for movement of the second top segment 16 toward and away from the second bottom segment 14 between the lowered position and the raised position. Specifically, the second middle brackets 28 are adjustable relative to the first middle brackets 27 along the upright axis U between the lowered position and the raised position and the second side brackets 30 are adjustable relative to the first side brackets 29 along the upright axis U between the lowered position and the raised position.

Specifically, each bracket assembly includes an adjustment mechanism 53 that can be operable by a user to adjust the position of the mattress foundation 10 between the lowered position and the raised position. Each middle bracket assembly 17 includes two adjustment mechanisms 53 spaced from each other along the first axis A (e.g., the longitudinal axis A), as shown in the example, in the figures. In the examples shown in the figures, the side bracket assemblies 21, 22 each include one adjustment mechanism 53. In the example shown in the figures, the adjustment mechanisms 53 on the middle bracket assembly 17 and the side bracket are identical. In other examples, the middle bracket assembly 17 and the side bracket assemblies 21, 22 may include different adjustment mechanisms 53.

The adjustment mechanism 53 includes adjustment holes, an adjustment slot 58 (i.e., an elongated hole), and adjustment fasteners 59, as described further below. Specifically, the second bracket (e.g., the second middle bracket 28 or first side bracket 30) includes a first adjustment hole 54, a second adjustment hole 55, and an end hole 56 each aligned with each other along a line on or parallel to the upright axis U. In the example shown in the figures, the second adjustment hole 55 is below the first adjustment hole 54 along the upright axis U and the end hole 56 is below the second adjustment hole 55 along the upright axis U. The first bracket (e.g., the first middle bracket 27 or the first side bracket 29) includes a first adjustment hole 57 and an adjustment slot 58 aligned with each other along a line on or parallel to the upright axis U. In the example shown in the figures, the adjustment slot 58 is below the first adjustment hole 57 of the first bracket. The adjustment slots 58 are each elongated along a line on or parallel to the upright axis U. The first adjustment hole 57 of the first bracket is aligned with the first adjustment hole 54 of the second bracket in the lowered position and the first adjustment hole 57 of the first bracket is aligned with the second adjustment hole 55 of the second bracket in the raised position in the example shown in the figures. An adjustment fastener 59 is engageable with the first adjustment hole 54 of the second bracket and the first adjustment hole 57 of the first bracket in the lowered position and is engageable with the second adjustment hole 55 of the second bracket and the first adjustment hole 57 of the first bracket in the raised position. An adjustment fastener 59 is engaged with the adjustment slot 58 of the first bracket and the end hole 56 of the second bracket.

Specifically, in the example middle bracket assemblies 17 shown in the figures, the second middle bracket 28 includes two first adjustment holes 54, two second adjustment holes 55 below the first adjustment holes, respectively, along the upright axis U, and two end holes 56 below the second adjustment holes 55, respectively, along the upright axis U. The first middle bracket 27 includes two first adjustment holes 57 and two adjustment slots 58 below the first adjustment holes 57 of the first middle bracket 27.

The first adjustment holes 57 of the first middle bracket 27 are aligned with the first adjustment holes 54 of the second middle bracket 28 in the lowered position and the first adjustment holes 57 of the first middle bracket 27 are aligned with the second adjustment holes 55 of the second middle bracket 28 in the raised position in the example shown in the figures. An adjustment fastener 59 is engageable with the first adjustment hole 54 of the second middle bracket 28 and the first adjustment hole 57 of the first middle bracket 27 in the lowered position and is engageable with the second adjustment hole 55 of the second middle bracket 28 and the first adjustment hole 57 of the first middle bracket 27 in the raised position. Other adjustment fasteners 59 are engaged with the end holes 56 of the second side bracket 30 and the adjustment slots 58 of the first side bracket 29. To move the middle bracket assembly 17 from the raised position to the lowered position, the user removes the adjustment fasteners 59 from the second adjustment holes 55 of the second middle bracket 28 and the first adjustment holes 57 of the first middle bracket 27. In some examples, to move the middle bracket assembly 17, the user may loosen and/or remove the adjustment fasteners 59 in the end holes 56 and adjustment slots 58; and in other examples the user may not need to loosen the adjustment fasteners 59 in the end holes 56 and adjustment slots 58 and instead the adjustment fasteners 59 slide along the slots 58 without loosening after removal of the fasteners 59 from the second adjustment holes 55 of the second middle bracket 28 and the first adjustment holes 57 of the first middle bracket 27. The user aligns the first adjustment holes 54 of the second middle bracket 28 with the first adjustment holes 57 of the first middle bracket 27 and inserts the adjustment fasteners 59 into the first adjustment holes 54 of the second middle bracket 28 and the first adjustment holes 57 of the first middle bracket 27. The user then tightens the adjustment fasteners 59 in the end holes 56 and the adjustment slots 58. To move the middle bracket assembly 17 from the lowered position to the raised position, the user removes the adjustment fasteners 59 from the first adjustment holes 54 of the second middle bracket 28 and the first adjustment holes 57 of the first bracket. The user aligns the second adjustment holes 54 of the second middle bracket 28 with the first adjustment holes 57 of the first middle bracket 27 and inserts the adjustment fasteners 59 into the second adjustment holes 55 of the second middle bracket 28 and the first adjustment holes 57 of the first middle bracket 27. The user then tightens the adjustment fasteners 59 in the end holes 56 and the adjustment slots 58. The adjustment fasteners 59 in the end holes 56 and adjustment slots 58 slide along the adjustment slots 58 during height adjustment.

In the example side bracket assemblies 21, 22 shown in the figures, the second side bracket 30 includes a first adjustment hole 60, a second adjustment hole 61 below the first adjustment hole 60 along the upright axis U, and an end hole 62 below the second adjustment hole 61 along the upright axis U. The first side bracket 29 includes a first adjustment hole 63 and an adjustment slot 64 below the first adjustment hole 63 of the first side bracket 29.

The first adjustment hole 63 of the first side bracket 29 is aligned with the first adjustment hole 60 of the second side bracket 30 in the lowered position and the first adjustment hole 63 of the first side bracket 29 is aligned with the second adjustment hole 61 of the second side bracket 30 in the raised position in the example shown in the figures. An adjustment fastener 59 is engageable with the first adjustment hole 60 of the second side bracket 30 and the first adjustment hole 63 of the first side bracket 29 in the lowered position and is engageable with the second adjustment hole 61 of the second side bracket 30 and the first hole 63 of the first side bracket 29 in the raised position. Another adjustment fastener 59 is engaged with the end hole 62 of the second side bracket 30 and the adjustment slot 58 of the first side bracket 29. To move the side bracket assembly 21, 22 from the raised position to the lowered position, the user removes the adjustment fastener 59 from the second adjustment hole 61 of the second side bracket 30 and the first adjustment hole 63 of the first side bracket 29. In some examples, to move the side bracket assembly 21, 22, the user may loosen and/or remove the adjustment fasteners 59 in the end hole 62 and adjustment slots 64; and in other examples the user may not need to loosen the adjustment fasteners 59 in the end hole 62 and adjustment slot 64 and instead the adjustment fastener 59 slides along the slot 64 without loosening after removal of the fasteners 59 from the second adjustment hole 61 of the second side bracket 30 and the first adjustment hole 63 of the first side bracket 29. The user aligns the first adjustment hole 60 of the second side bracket 30 with the first adjustment hole 63 of the first side bracket 29 and inserts the adjustment fastener 59 into the first adjustment hole 60 of the second side bracket 30 and the first adjustment hole 63 of the first side bracket 29. The user then tightens the adjustment fastener 59 in the end hole and the adjustment slot 58. To move the side bracket assembly 21, 22 from the lowered position to the raised position, the user removes the adjustment fastener 59 from the first hole 60 of the second side bracket 30 and the first hole 63 of the first side bracket 29. The user aligns the second hole 61 of the second side bracket 30 with the first hole 63 of the first side bracket 29 and inserts the adjustment fastener 59 into the second hole 61 of the second side bracket 30 and the first hole 63 of the first side bracket 29. The user then tightens the adjustment fastener 59 in the end hole 62 and the adjustment slot 64. The adjustment fastener 59 in the end hole 62 and adjustment slot 64 slide along the adjustment slot 64 during height adjustment.

As shown in the example in FIGS. 14A-15B, the mattress foundation 10 may be adjustable to one or more intermediate position between the raised position and the lowered position. In such an example the second bracket, i.e., each of the second middle bracket 28 and the second side bracket 30, includes a third adjustment hole 65, 66 between the first adjustment hole 54, 60 of the second bracket 28, 30 and the second adjustment hole 55, 61 of the second bracket 28, 30. Specifically, for the middle bracket assemblies 17, the first hole 57 of the first middle bracket 27 is aligned with the third hole 65 of the second middle bracket 28 in the intermediate position and the adjustment fastener 59 is engaged with the first hole 57 and the third hole 65 in the intermediate position. For the side bracket assemblies 21, 22, the first hole 66 of the first side bracket 29 is aligned with the third hole 66 of the second side bracket 30 in the intermediate position and the adjustment fastener 59 is engaged with the first hole 63 and the third hole 66. In the example shown in FIGS. 14A15B, the mattress foundation 10 is in the raised position and can be selectively lowered to the intermediate position or the lowered position. In the example shown in FIGS. 14A and 15A, the mattress foundation 10 has one intermediate position between the raised position and the lowered position. In other examples, for example FIGS. 14B and 15B, the mattress foundation 10 can have any suitable number of intermediate positions, i.e., by duplicating the third hole 65, 66 at different positions along the upright axis U between the first hole 54, 60 and the second hole 55, 61.

Figure 13:
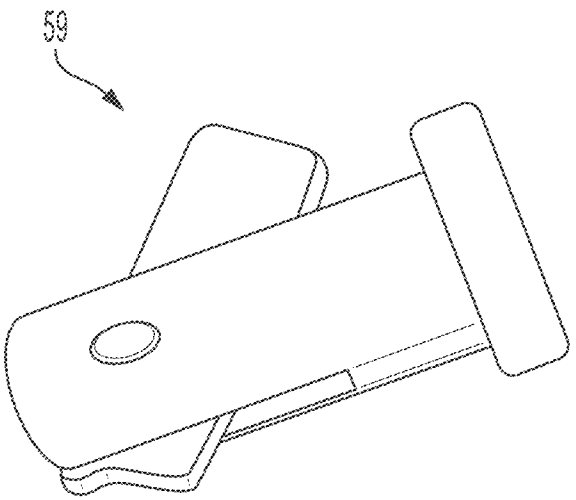
FIG. 13 is a perspective view of another example of an adjustment fastener.
Figure 12:
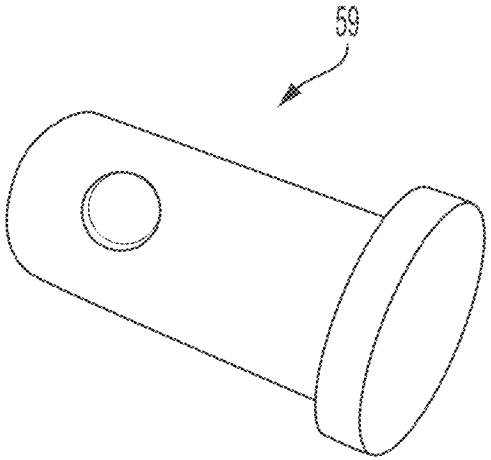
FIG. 12 is a perspective view of another example of an adjustment fastener.
Figure 14A:
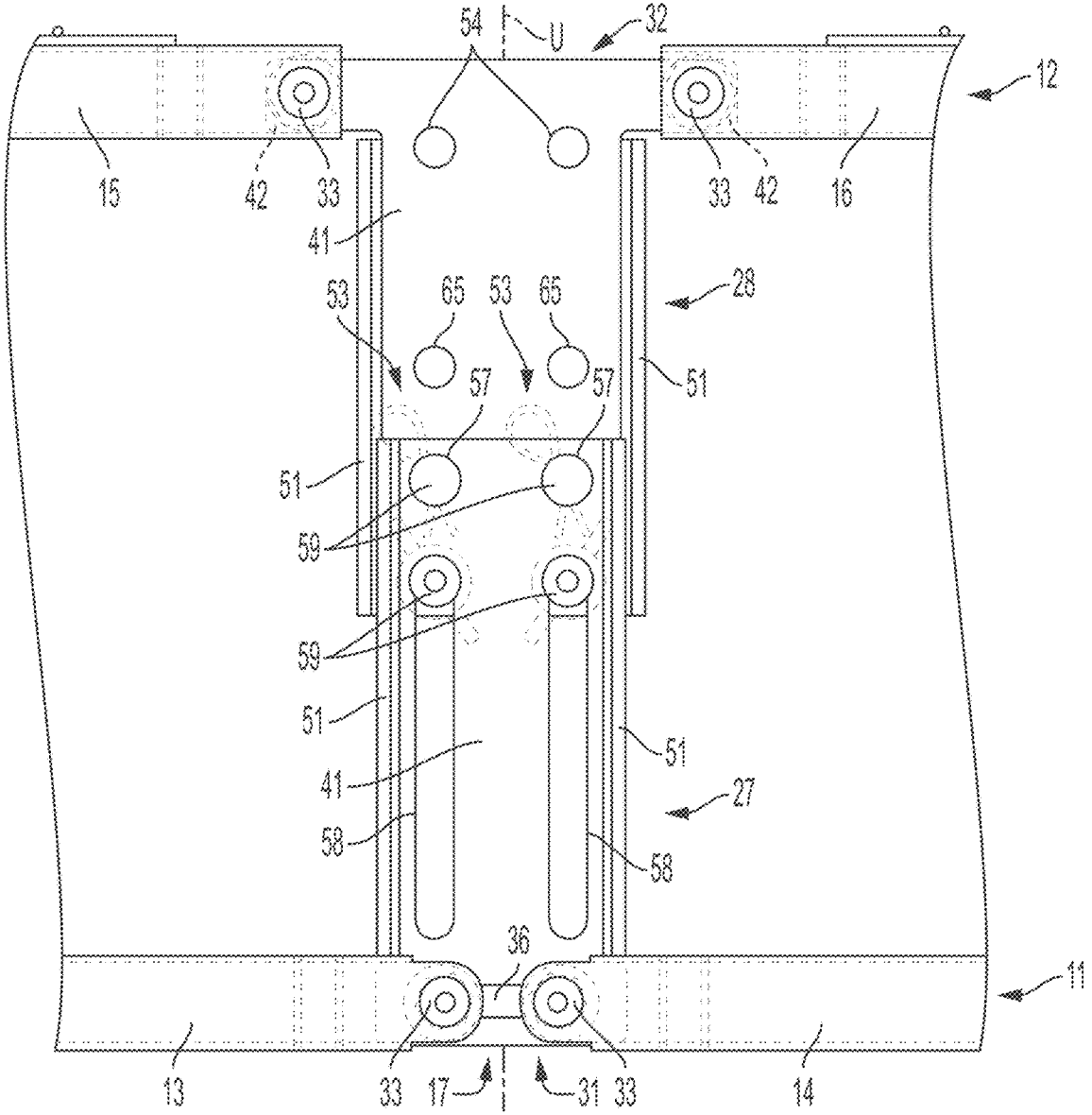
FIG. 14A is a side view of an example of the middle bracket assembly when the mattress foundation is in the unfolded position and the raised position.
Figure 14B:
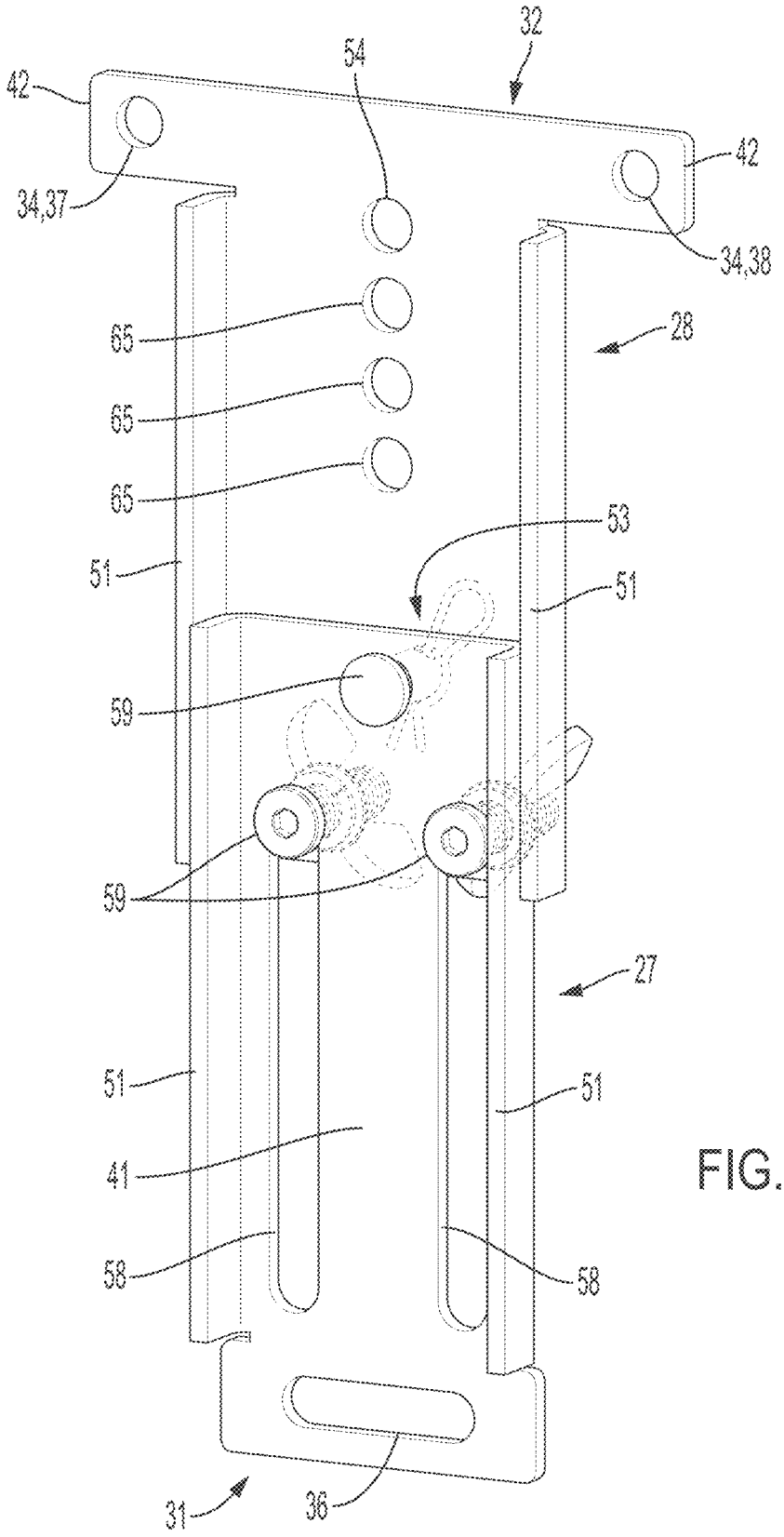
FIG. 14B is a perspective view of another example of the middle bracket assembly.
Figure 15A:
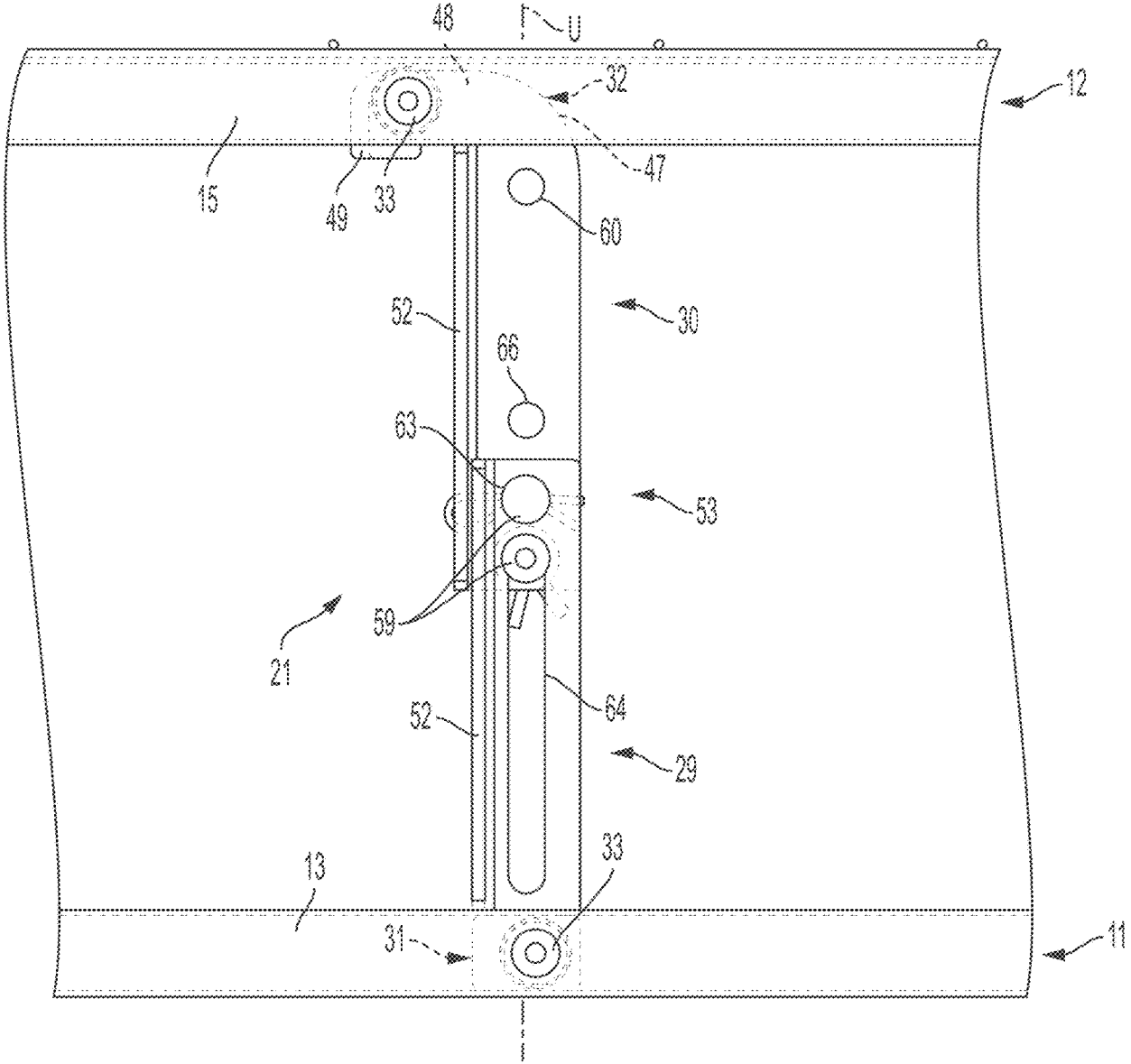
FIG. 15A is a side view of an example of the side bracket assembly when the mattress foundation is in the unfolded position and the raised position.
Figure 15B:
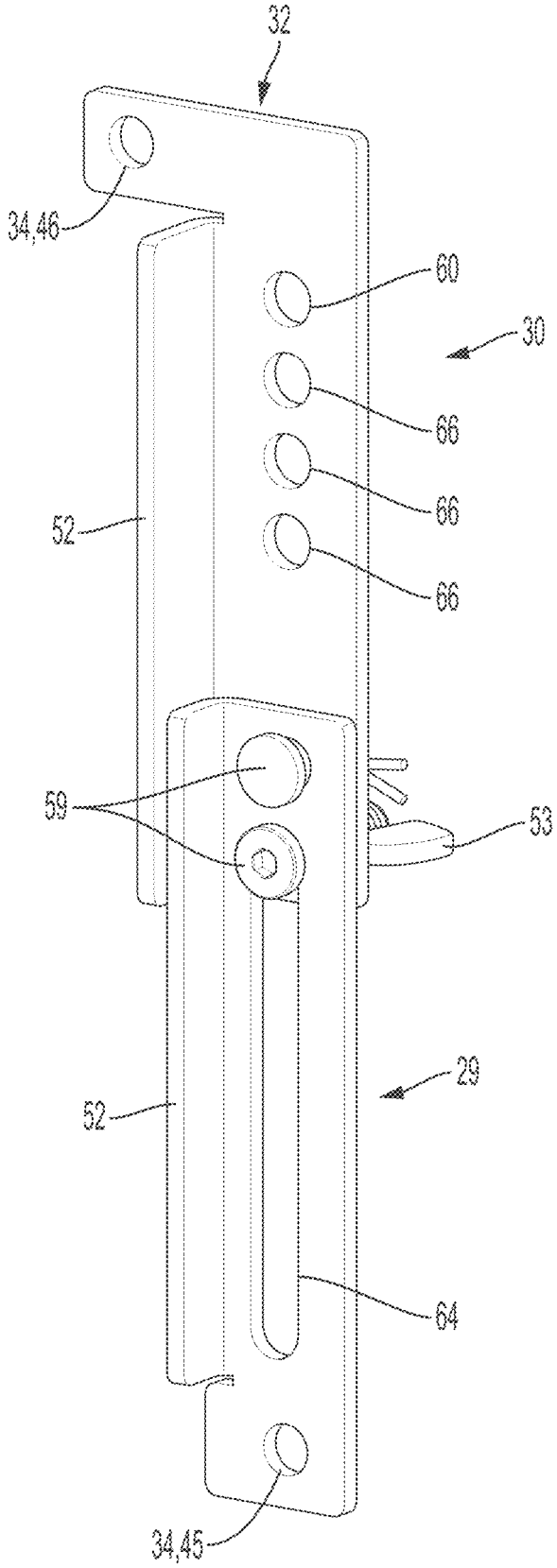
FIG. 15B is a perspective view of another example of the middle bracket assembly.

The adjustment fasteners 59 may be of any suitable type. For example, in the example shown in the figures, the adjustment fastener 59 extendable through the end hole 56, 62 of the second middle bracket 28/second side bracket 30 and the slot 36 of the first middle bracket 27/first side bracket 29 is a threaded fastener and a wing nut threadedly engaged with the threaded fastener. As another example, in the example shown in the figures, the adjustment fastener 59 extendable through the first hole 57, 63 of the first middle bracket 27/first side bracket 29 is a clevis pin and a cotter pin releasable engageable with a hole in the clevis pin. As another example, as shown in FIG. 12, the adjustment fastener 59 may be a pin with a spring-loaded ball bearing. As yet another example, as shown in FIG. 13, the adjustment fastener 59 may be a pin with a releasable lock-out bar that may be spring loaded, have a detent, etc.

With reference to FIGS. 1, 3 19, 20, and 25-29, the mattress foundation 10 includes at least one latch arm 67 on one of the bottom frame 11 or the top frame 12 and studs 68, 69 on the other of the bottom frame 11 or the top frame 12. The studs 68, 69 are spaced from each other along the second axis B. Specifically, the studs 68, 69 are spaced from each other such that the latch arm 67, e.g., a hook 74 of the latch arm 67, is positioned to engage one of the studs 68 in the raised position and the other of the studs 69 in the lowered position. The latch arm 67 is rotatable to engage one of the studs 68 in the raised position and to engage the other of the studs 69 in the lowered position. The engagement of the latch arm 67 with the stud 68, 69 locks the mattress foundation 10 in the desired height. The engagement of the latch arm 67 with the stud 68, 69 reduces wobble of the mattress foundation 10, i.e., provides lateral stability.

The latch arm 67 may be rotatably engaged relative to the bottom frame 11/top frame 12 to which the latch arm 67 is on, e.g., with a hinge 76. In examples including the hook 74, the hook 74 is on a rotational path centered on the hinge 76. The rotational path 76 intersects the stud 68 in the raised position and the rotational path 76 intersects the stud 69 in the lowered position. The location of the hinge 76, the location of the studs 68, 69, and the length of the latch arm 67 are designed so that the rotational path 76 of the hook 74 intersects the stud 68 in the raised position and the rotational path 76 of the hook 74 intersects the stud 69 in the lowered position.

The latch arm 67 may engage the studs 68, 69 in any suitable way. In the example shown in the figures, the latch arm 67 includes a hook 74 that receives the studs 68, 69. In that example shown in the figures, the hook is formed by an open-ended void 74 that receives the stud 68, 69. In such an example, the hook 74 of the latch arm 67 and the studs 68, 69 may be sized and shaped so that the latch arm 67 may be engaged and/disengaged with the studs 68, 69 by hand, e.g., without the use of a tool. Specifically, the hook 74 of the latch arm 67 and the studs 68, 69 may be sized and shaped so that the latch arm 67 remains engaged with the stud 68, 69 until disengaged by hand. As an example, the hook 74 of the latch arm 67 and the studs 68, 69 may be sized for a friction fit therebetween when engaged. The latch arm 67 releasably engages the stud 68, 69, i.e., the latch arm 67 and the stud 68, 69 are configured, i.e., sized, shaped, positioned, so that the latch arm 67 can be selectively engaged with and disengaged with the stud 68, 69 for adjustment of the height of the mattress foundation 10.

Figure 28:
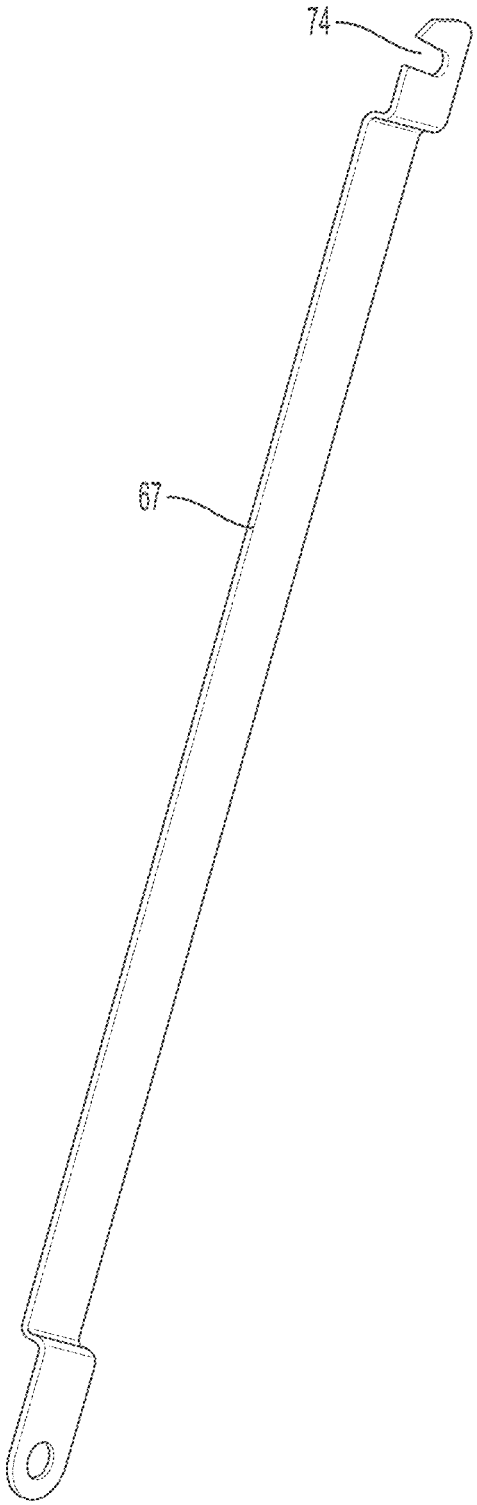
FIG. 28 is a perspective view of an example latch arm.
Figure 29:
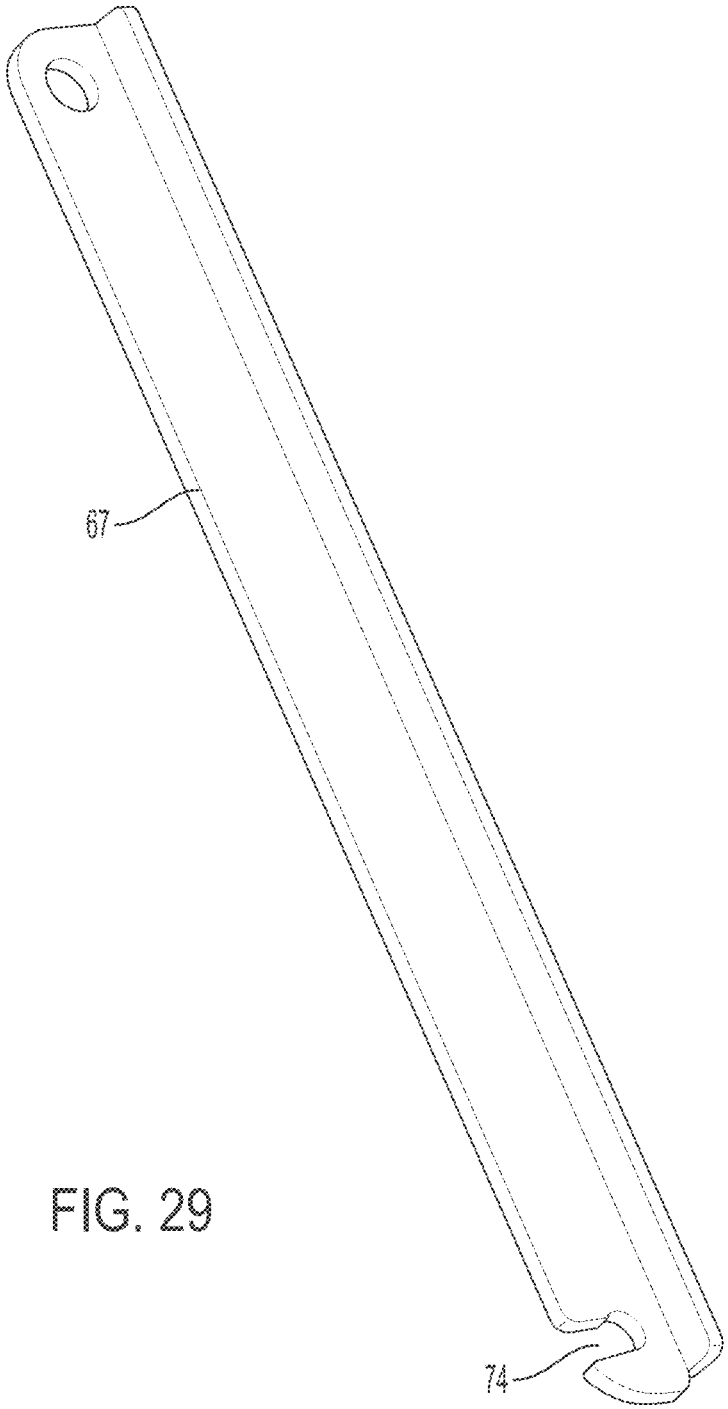
FIG. 29 is a perspective view of another example latch arm.

Two examples of the latch arm 67 are shown in FIGS. 28 and 29. In the example in FIG. 28, the latch arm 67 includes an elongated flat middle portion and bends near the hook 74 and the hinge 76. In the example shown in FIG. 29, the latch arm 67 has a flange, e.g., at a right angle in FIG. 29.

The mattress foundation 10 may include any suitable number of latch arms 67 and corresponding studs 68, 69. In the example shown in FIGS. 1, 3 19, and 20, the mattress foundation 10 includes four latch arms 67 and corresponding studs 68, 69. Specifically, the mattress foundation 10 includes one latch arm 67 and corresponding studs 68, 69 at each outer corner of the mattress foundation 10. In other examples, the mattress foundation 10 may include one latch arm 67 and corresponding studs 68, 69 at two diagonally-opposite outer corners of the mattress foundation 10. The location of the latch arm 67 and studs 68, 69 at an outer corner of the mattress foundation 10 reduces wobble of the mattress foundation 10. The larch arm 67 and the studs 68, 68 may be on the base beams 23, as shown in the example, in the figures. In other words, the grouped latch arm 67/studs 68, 69 are spaced from each other along the first axis A, e.g., the longitudinal axis A. When the mattress foundation 10 is in use, the location of the latch arm 67 and studs 68, 69 on the base beams 23 provide added stability at a foot end of the mattress foundation 10, which may be sat upon by a user. The latch arm 67 is transverse to the base beam 23 of the bottom frame 11 and the base beam 23 of the top frame 12 at a non-right angle when engaged with stud 68, 69. In the example shown in FIGS. 1, 3 19, and 20, the latch arms 67 are transverse at non-right angles to the bottom frame 11 and the top frame 12 in both the raised position and the lowered position. In the example shown in FIGS. 1, 3 19, and 20, the latch arms 67 are between the base beams 23 of the top segment 12, 16 and the bottom segment frame 13, 15.

Figure 25:
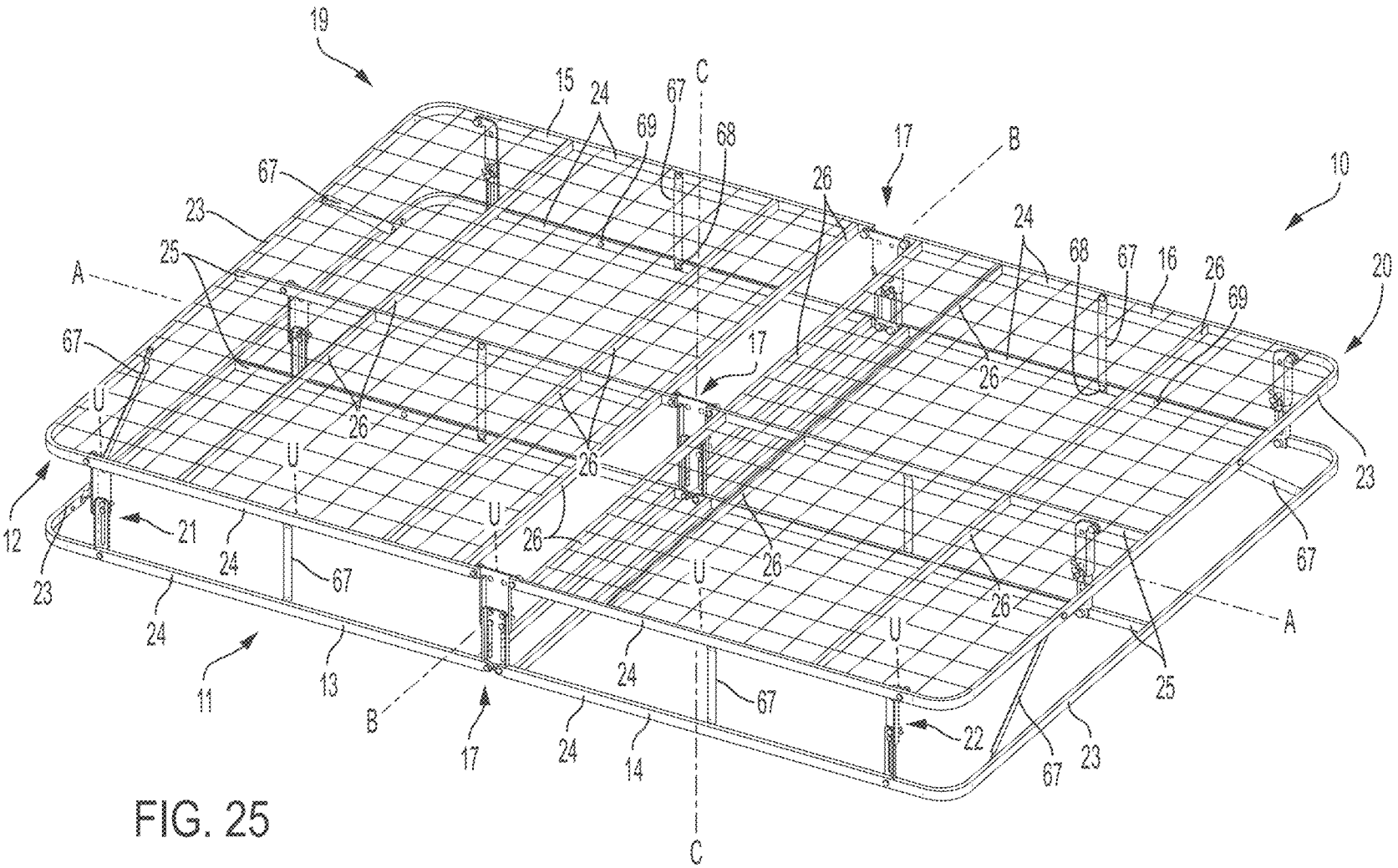
FIG. 25 is a perspective view of another example mattress foundation in the raised position.
Figure 26:
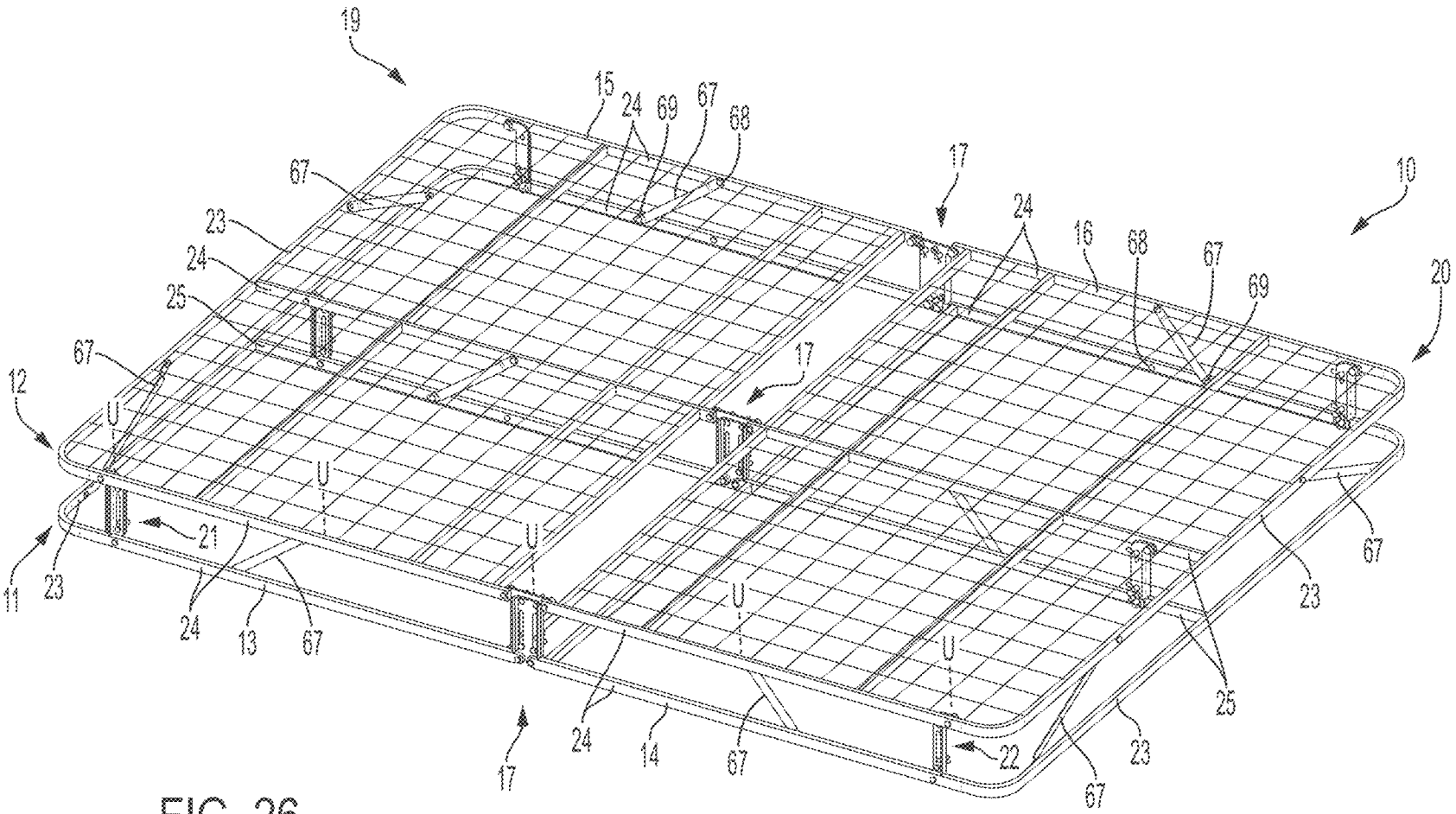
FIG. 26 is a perspective view of the example mattress foundation of FIG. 25 in the lowered position.
Figure 27:
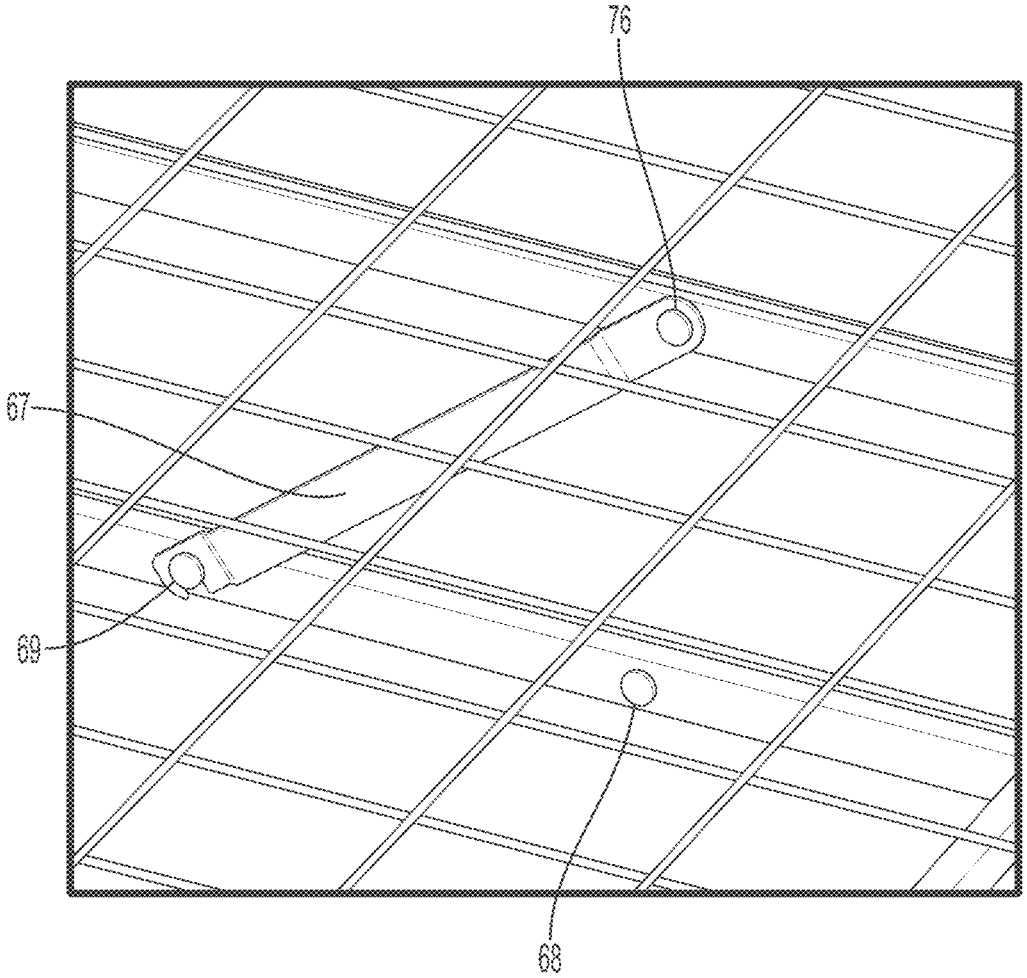
FIG. 27 is a magnified portion of FIG. 26.

In the example shown in FIGS. 25-27, the mattress foundation 10 includes other examples of latch arms 67. Four of the latch arms 67 in FIGS. 25-26 are vertical from the bottom frame 11 to the top frame 12 in the raised position (FIG. 25)) and are transverse at non-right angles to the bottom frame 11 and the top frame 12 in the lowered position (FIG. 26). In the example shown in FIGS. 25-27, the latch arms 67 are between the leg beams 24 of the top segment 12, 16 and the bottom segment frame 13, 15.

Figure 21:
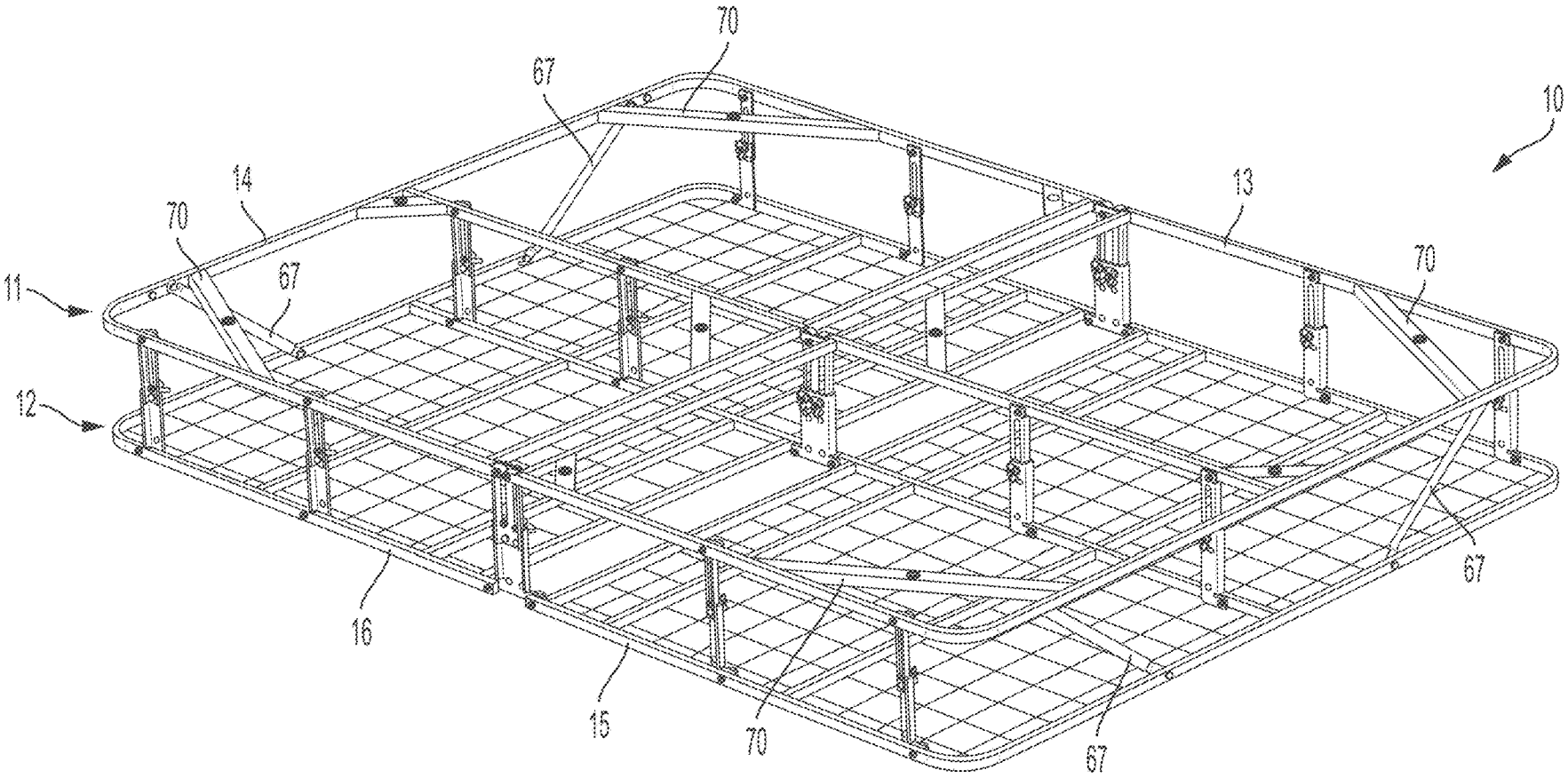
FIG. 21 is a bottom perspective view of an example of the mattress foundation.
Figure 22:
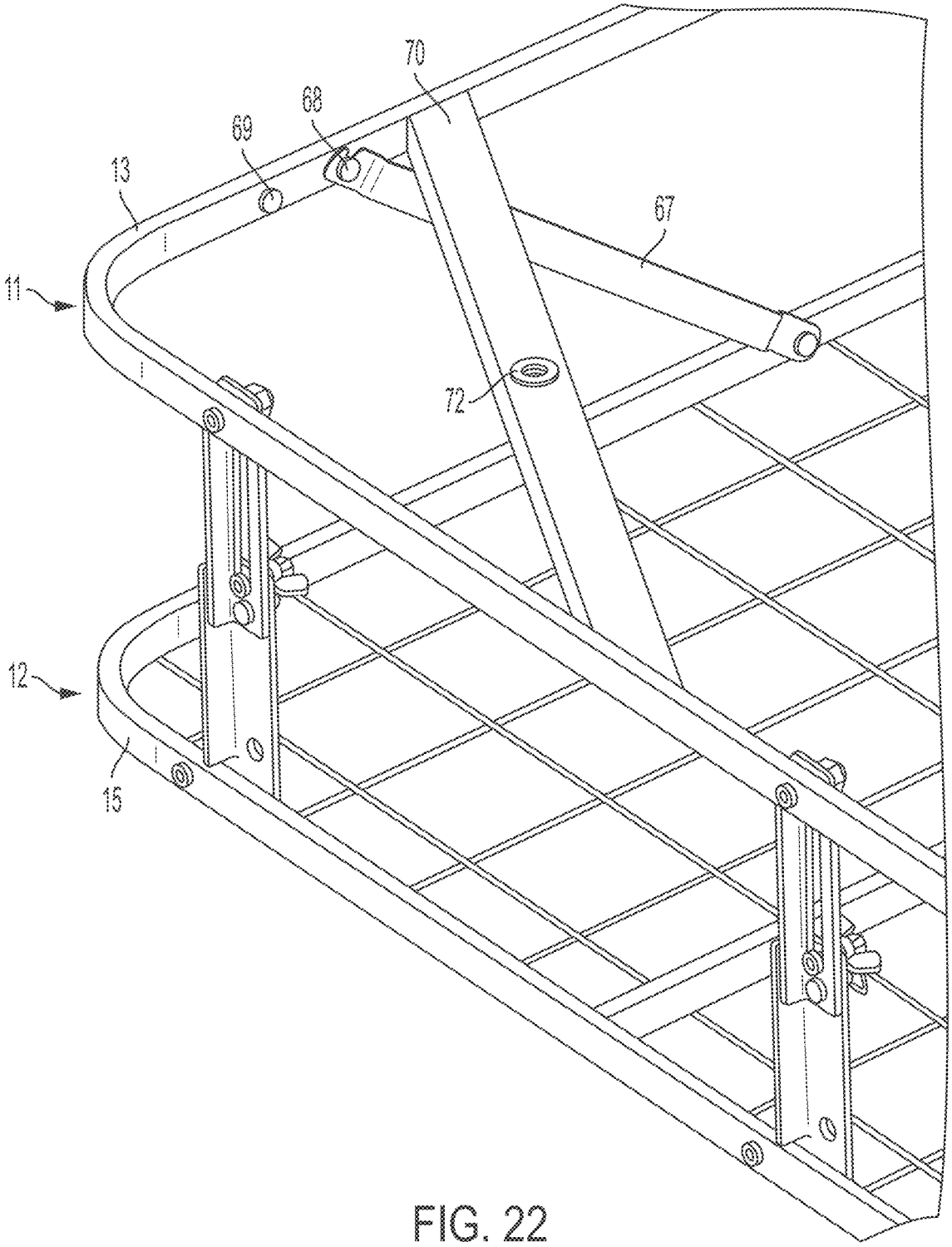
FIG. 22 is a magnified view of a portion of FIG. 21.
Figure 23:
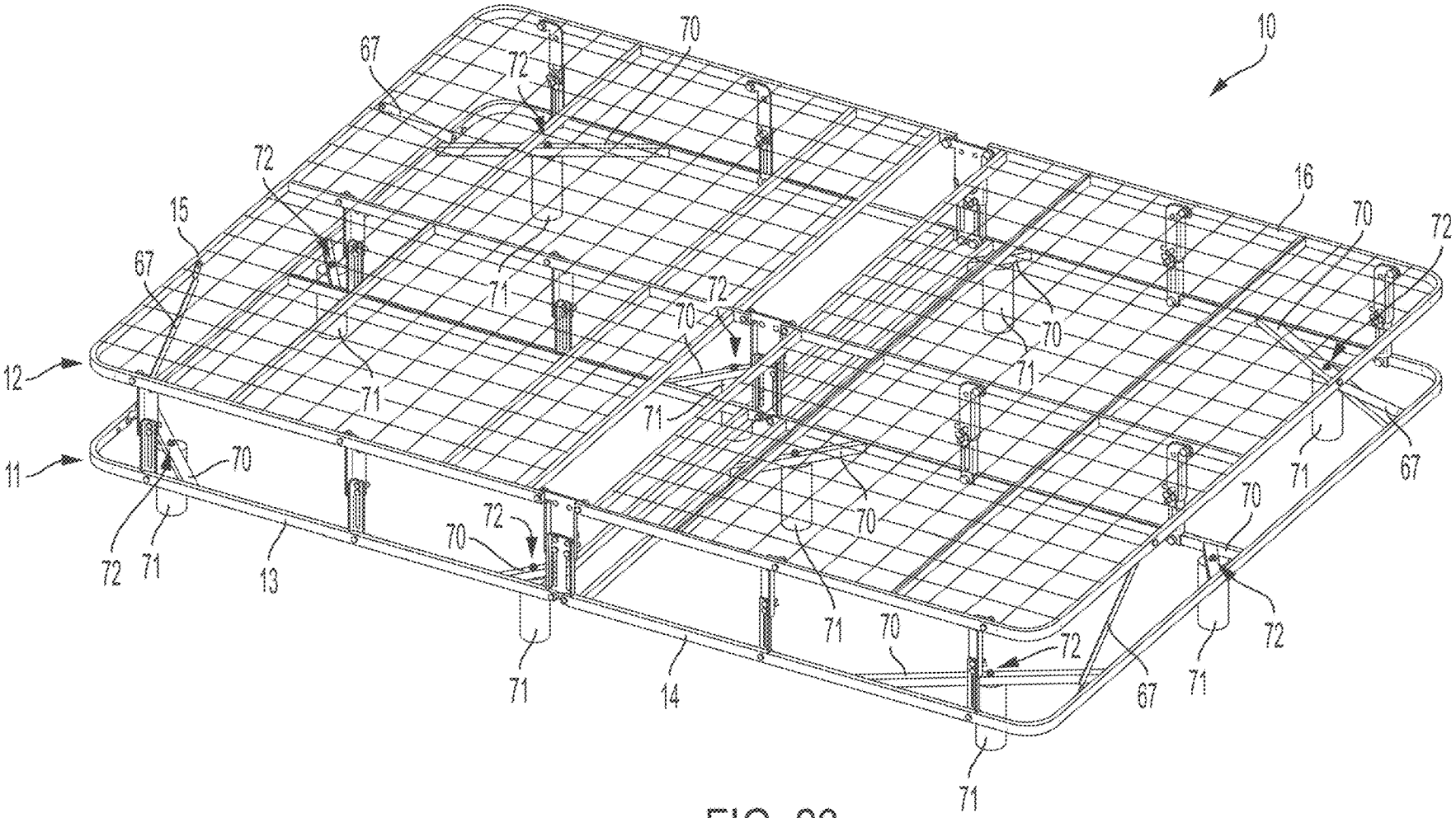
FIG. 23 is a top perspective view of the example mattress foundation of FIG. 21 with legs.

With reference to FIGS. 21-23, the mattress foundation 10 may include leg braces 70 and legs 71. The leg braces 70 are fixed to the bottom frame 11 and the legs are removably engaged with the leg braces 70. In the example shown in FIGS. 21-23, the mattress foundation 10 includes five leg braces 70 and corresponding legs 71 on each of the first side 19 and the second side 20. In other examples, the mattress foundation 10 may include any suitable number of leg braces 70 and legs 71.

In the example shown in FIGS. 21-23, the leg braces 70 are fixed to the bottom frame 11 by welding. In addition or in the alternative, the braces may be fixed to the bottom frame 11 in any suitable fashion such as fasteners, unitary formation, adhesive, etc. The leg braces 70, for example, may be metal or any other suitable material.

At least some of the leg braces 70 may extend across outer corners of the bottom frame 11 and at least some of the leg braces 70 may extend across inner corners of the bottom frame 11.

The leg braces 70 and each corresponding leg 71 includes interlocking connection members 72 that connect the leg 71 to the respective leg brace 70. As an example, the interlocking connection members 72 may be releasably engageable with each other so that the legs 71 may be assembled to and disassembled from the respective leg braces 70 without destruction of the leg brace 70 and/or the leg 71. The interlocking connection members 72 may be, for example, threadedly engageable and disengageable with each other. For example, the interlocking connection members 72 may include a threaded hole on one of the leg brace 70 and the leg 71 and a threaded stud on the other of the leg brace 70 and the leg 71. For example, in the example shown in FIGS. 21-23, the interlocking connection member 72 on the leg brace 70 is a threaded hole. In such an example, the leg 71 includes a threaded stud that is threadedly engageable with the threaded hole. The releasable connection members 72, e.g., the threaded hole and the threaded stud, may be engaged with each other after the mattress foundation 10 is placed in the unfolded position.

The example legs 71 shown in FIGS. 21-23 are one-piece. In other examples, the legs 71 may be two-piece, three-piece, or may include any suitable number of pieces. In examples in which the legs 71 include more than one piece, the multiple pieces may be used to adjust the height of the leg 71 from a bottom of the leg 71, e.g., the portion of the leg 71 that rests on ground, to the bottom frame 11. As an example, the legs 71 may be of the type disclosed in U.S. Pat. No. 9,451,833, which is incorporated herein by reference.

Figure 24:
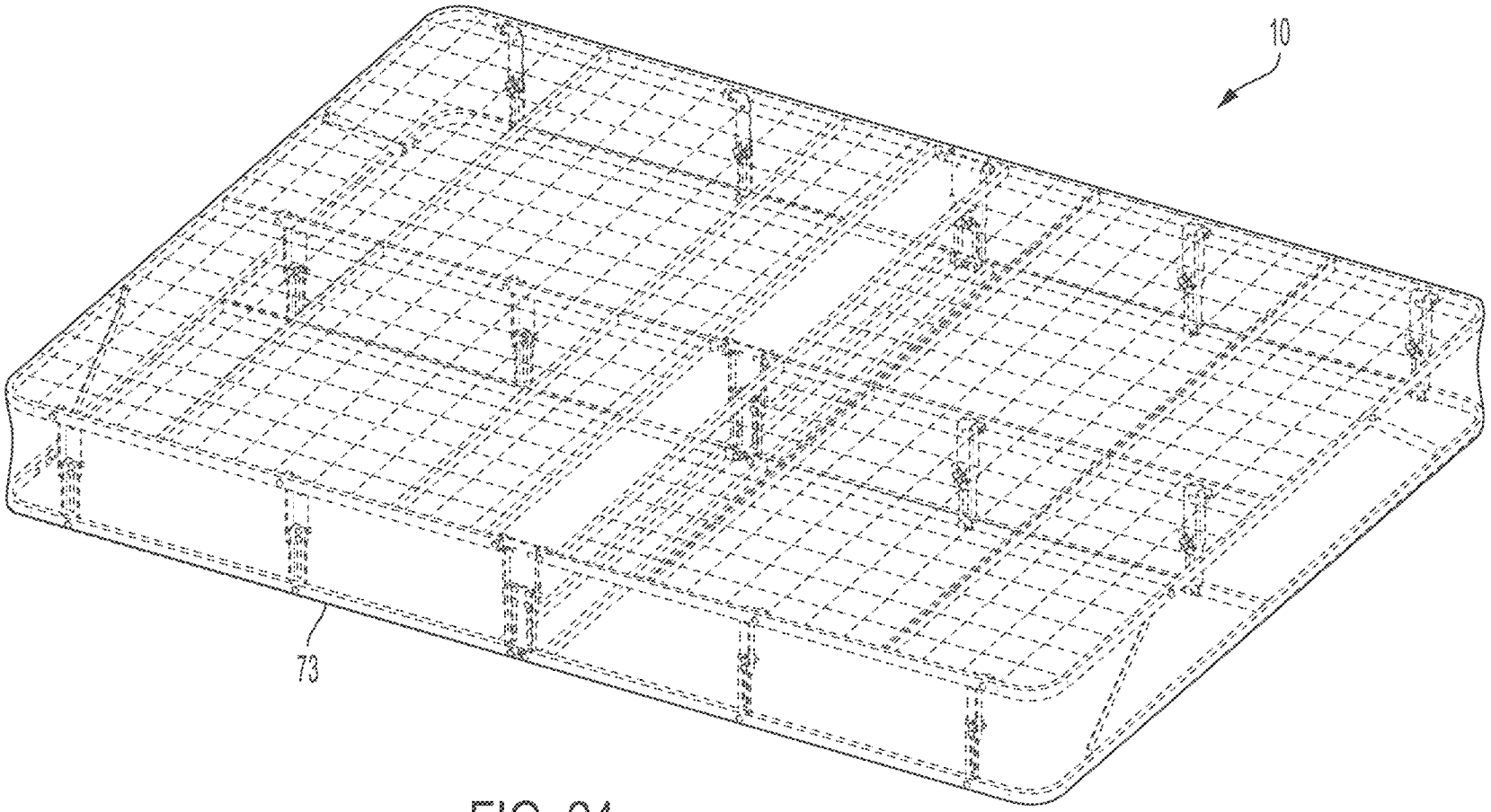
FIG. 24 is a perspective view of an example cover on the mattress foundation.

With reference to FIG. 24, the mattress foundation 10 includes a removable cover 73. The removable cover 73 wraps around the bottom frame 11 and the top frame 12. The removable cover 73 may have elastic at the corners and/or a draw string to cinch the removable cover 73. The removeable cover 73 may be fabric, polymeric sheet, a combination of both, etc.

The disclosure has been described in an illustrative manner, and it is to be understood that the terminology which has been used is intended to be in the nature of words of description rather than of limitation. Many modifications and variations of the present disclosure are possible in light of the above teachings, and the disclosure may be practiced otherwise than as specifically described.

What is claimed is:

1. A mattress foundation comprising:

a top frame;

a bottom frame; and a bracket assembly between the top frame and the bottom frame;

the bracket assembly having an upright axis, the top frame and the bottom frame being spaced from each other along the upright axis;

the bracket assembly including:

a first bracket and a second bracket, one of the first bracket and the second bracket being below the other of the first bracket and the second bracket along the upright axis;

the top frame being connected to one of the first bracket and the second bracket and the bottom frame being connected to the other of the first bracket and the second bracket;

the first bracket and the second bracket being adjustable relative to each other along the upright axis between a lowered position and a raised position;

the second bracket includes a first hole and a second hole below the first hole along the upright axis;

the first bracket includes a first hole; and the first hole of the first bracket is aligned with the first hole of the second bracket in the lowered position and the first hole of the first bracket is aligned with the second hole of the second bracket in the raised position;

the first bracket includes a second hole elongated along the upright axis; and the second bracket further including an end hole aligned with the second hole of the first bracket along the upright axis in both the lowered position and the raised position.

2. The mattress foundation as set forth in claim 1, further comprising a fastener, the fastener being engageable with the first hole of the second bracket and the first hole of the first bracket in the lowered position, and the fastener being engageable with the second hole of the second bracket and the first hole of the first bracket in the raised position.

3. The mattress foundation as set forth in claim 1, wherein the second bracket includes a third hole between the first hole of the second bracket and the second hole of the second bracket, and the first hole of the first bracket is aligned with the third hole of the second bracket in an intermediate position between the lowered position and the raised position.

4. The mattress foundation as set forth in claim 1, further comprising a fastener engaged with the second hole of the first bracket and the end hole of the second bracket, the fastener configured to slide within the second hole as the first bracket and the second bracket are adjusted between the lowered position and the raised position.

5. The mattress foundation as set forth in claim 1, wherein the top frame is pivotally connected to one of the first bracket and the second bracket and the bottom frame is pivotally connected to the other of the first bracket and the second bracket.

6. The mattress foundation as set forth in claim 1, wherein the top frame and the bottom frame are foldable relative to each other between a folded position and an unfolded position.

7. The mattress foundation as set forth in claim 1, wherein:

the top frame has a first top segment and a second top segment;

the bottom frame has a first bottom segment and a second bottom segment; and the first top segment and the first bottom segment being rotatable relative to the second top segment and the second bottom segment between a folded position and an unfolded position.

8. The mattress foundation as set forth in claim 7, wherein the bracket assembly is one of a plurality of bracket assemblies, the plurality of bracket assemblies including a middle bracket assembly;

the first top segment and the second top segment are connected to one of the first bracket and the second bracket of the middle bracket assembly; and the first bottom segment and the second bottom segment are connected to the other of the first bracket and the second bracket of the middle bracket assembly.

9. The mattress foundation as set forth in claim 8, wherein the plurality of bracket assemblies further includes:

a first side bracket assembly connecting the first top segment to the first bottom segment; and a second side bracket assembly connecting the second top segment to the second bottom segment;

the top frame and the bottom frame are both elongated along a longitudinal axis, the first side bracket assembly being spaced from the middle bracket assembly in one direction along the longitudinal axis and the second side bracket being spaced from the middle bracket assembly in an opposite direction along the longitudinal axis.

10. The mattress foundation as set forth in claim 1, wherein the bracket assembly is a middle bracket assembly being spaced from each other along a lateral axis perpendicular to the upright axis, the top frame and the bottom frame being rotatable about the middle bracket between a folded position and an unfolded position.

11. The mattress foundation as set forth in claim 10, wherein the middle bracket assembly includes a slot elongated along a first axis transverse to the upright axis, the top frame or the bottom frame being rotatably connected to the slot.

12. The mattress foundation as set forth in claim 11, further comprising:

a first fastener extending through the slot; and a second fastener extending through the slot;

the top frame or the bottom frame being rotatably connected to the slot with the first fastener and the second fastener.

13. A mattress foundation comprising:

a top frame having a first top segment and a second top segment;

a bottom frame having a first bottom segment and a second bottom segment; and a bracket assembly between the top frame and the bottom frame;

the first top segment and the first bottom segment being rotatable relative to the second top segment and the second bottom segment between a folded position and an unfolded position; and the bracket assembly adjustably connecting the top frame and the bottom frame in the unfolded position for movement of the top frame toward and away from the bottom frame between a lowered position and a raised position along an upright axis, the top frame and the bottom frame being spaced from each other along the upright axis in the unfolded position;

wherein the bracket assembly includes: a first bracket and a second bracket, one of the first bracket and the second bracket being below the other of the first bracket and the second bracket along the upright axis;

the top frame being connected to one of the first bracket and the second bracket and the bottom frame being connected to the other of the first bracket and the second bracket;

the first bracket and the second bracket being adjustable relative to each other along the upright axis between the lowered position and the raised position;

the first bracket includes a first hole and a second hole disposed along the upright axis, the second hole elongated along the upright axis;

the second bracket includes a first hole and a second hole disposed along the upright axis; and the first hole of the first bracket is aligned with the first hole of the second bracket in the lowered position, the first hole of the first bracket is aligned with the second hole of the second bracket in the raised position;

the second hole of the first bracket aligned with the second hole of the second bracket in both the lowered position and the raised position.

14. The mattress foundation as set forth in claim 13, wherein:

the first top segment and the second top segment are coplanar in the unfolded position in an upper plane;

the first bottom segment and the second bottom segment are coplanar in the unfolded position in a lower plane; and the upper plane is parallel to the lower plane.

15. The mattress foundation as set forth in claim 13, further comprising a fastener engageable with the first hole of the second bracket and the first hole of the first bracket in the lowered position and engageable with the first hole of the first bracket and the second hole of the second bracket in the raised position.

16. The mattress foundation as set forth in claim 13, wherein the second bracket includes a third hole between the first hole of the second bracket and the second hole of the second bracket and the first hole of the first bracket is aligned with the third hole of the second bracket in an intermediate position between the lowered position and the raised position.

17. A mattress foundation comprising:

a top frame;

a bottom frame; and a bracket assembly between the top frame and the bottom frame;

the bracket assembly having an upright axis, the top frame and the bottom frame being spaced from each other along the upright axis;

the bracket assembly including:

a first bracket and a second bracket, one of the first bracket and the second bracket being below the other of the first bracket and the second bracket along the upright axis;

the top frame pivotally connected to one of the first bracket and the second bracket and the bottom frame pivotally connected to the other of the first bracket and the second bracket, the top frame and the bottom frame foldable relative to each other between a folded position and an unfolded position;

the first bracket and the second bracket being adjustable relative to each other along the upright axis between a lowered position and a raised position;

the first bracket and the second bracket each including at least one flange that are nested with each other, the at least one flange abutting the top frame or the bottom frame when the top frame and the bottom frame are in the unfolded position.

18. The mattress foundation of claim 17, wherein the second bracket includes a first hole and a second hole below the first hole along the upright axis;

the first bracket includes a first hole; and the first hole of the first bracket is aligned with the first hole of the second bracket in the lowered position and the first hole of the first bracket is aligned with the second hole of the second bracket in the raised position;

the first bracket includes a second hole elongated along the upright axis; and the second bracket further including an end hole aligned with the second hole of the first bracket along the upright axis in both the lowered position and the raised position.

19. The mattress foundation of claim 18, wherein the second hole of the first bracket is an elongated slot.

20. The mattress foundation of claim 17, wherein the at least one flange is elongated along the upright axis.

* * * * *